US005223381A

United States Patent [19]

Hara et al.

[11] Patent Number: 5,223,381

[45] Date of Patent: Jun. 29, 1993

[54] PHOTOGRAPHIC FILM PACKAGE

[75] Inventors: Yoshio Hara; Masafumi Fukugawa; Katsumasa Okada; Hitoshi Komiyama, all of Kanagawa, Japan

[73] Assignee: Fuji Photo Film Co., Ltd., Kanagawa, Japan

[21] Appl. No.: 808,501

[22] Filed: Dec. 17, 1991

[30] Foreign Application Priority Data

Dec. 17, 1990 [JP] Japan ..... 2-411154

[51] Int. Cl.[5] ..... G03C 3/00

[52] U.S. Cl. ..... 430/496; 354/277; 354/278; 354/281; 354/283

[58] Field of Search ..... 430/496, 644; 354/275, 354/277, 278, 281, 282, 283

[56] References Cited

U.S. PATENT DOCUMENTS 4,725,865 2/1988 Hoffman, Jr. ..... 354/282

4,821,054 4/1989 Armbuster et al. ..... 354/282

*Primary Examiner*—Charles L. Bowers, Jr.

*Assistant Examiner*—Mark F. Huff

*Attorney, Agent, or Firm*—Sughrue, Mion, Zinn, Macpeak & Seas

[57] ABSTRACT

A photographic film package including a film unit and a light-shielding envelope for enclosing the film unit. The film unit has a photographic film sheet, first and second carrier sheets attached to opposite ends of the photographic film sheet, and a light-locking clip. The light-locking clip is attached to the first carrier sheet by caulking, and has a pair of waved clamping portions. The photographic film sheet is enclosed light-tightly in the light-shielding envelope when the clamping portions clamp an open end of the light-shielding envelope. The second carrier sheet is formed in its leading end portion with an opening extending transversely to the second carrier sheet, so that the inward-facing surfaces of the light-shielding envelope are brought into tight contact with each other through the opening when the light-shielding envelop is grasped at a region overlying the opening. After photographing, a leading end portion of the light-shielding envelope is folded as to fold the second carrier sheet along the opening. The folded leading end portion of the envelope is secured to the intermediate portion of the envelope by means of an adhesive tape.

53 Claims, 26 Drawing Sheets

PHOTOGRAPHIC FILM PACKAGE

BACKGROUND OF THE INVENTION

1. Field of the Invention

The present invention relates to film packages in which a sheet of photographic film is removably contained in a light-shielding envelope.

2. Background

A known photographic film package, mainly used by professional photographers, includes a relatively large film sheet, e.g., 12.5×10 cm film sheet, which is contained in a light-shielding envelope. For example, a film package disclosed in U.S. Pat. No. 4,821,054 comprises a film unit contained in a light-shielding envelope. The film unit consists of a carrier sheet having a light-locking clip secured to its trailing end for closing an open trailing end of the light-shielding envelope, and is formed at its leading end with a tab disposed eccentrically relative to the carrier sheet's longitudinal center line. A photographic film sheet is detachably adhesively attached to the carrier sheet at an intermediate region. The light-shielding envelope has numbers "1" and "2" printed on the leading end section thereof, such that a zone, which does not overlie the tab, is indicated by the number "1", whereas a zone which overlies the tab is indicated by the number "2". A part of the tab or a part of inner surface of the light-shielding envelope facing the tab is provided with a cold-adhesive agent.

The above described film package is inserted into a film holder, which is disposed on the back of a cooperating camera, through an access opening, such that the light-locking clip is placed into an innermost position in the film holder opposite to the access opening. In this state, the leading end section of the light-shielding envelope having the numbers "1" and "2" protrudes from the film holder. When a lock lever of the film holder is actuated, the light-locking clip is arrested in the film holder. In order to take a photographic picture, the light-shielding envelope is grasped at zone "1" and pulled out from the film holder. Because the zone "1" does not overlay the carrier sheet, the light-shielding envelope is moved relative to the film unit, so that when the light-shielding envelope has been pulled out to a predetermined position, the film sheet is uncovered. In this state, the film package is ready for photographing. After photographing, the light-shielding envelope is inserted back into the holder by grasping the zone "1" until the open end of the light-shielding envelope is closed by entry thereof into the light-locking clip, so that the film sheet is recovered by the light-shielding envelope in light-tight fashion. Thereafter, the lock lever is released so as to enable removal of the film package from the film holder. When removing the film package, zone "2" is grasped. Because zone "2" overlies the tab of the carrier sheet, the light-shielding envelope and the film unit are together grasped and are removed from the film holder by pulling the light-shielding envelope. At that time, because the light-shielding envelope is adhered at the zone "2" to the tab when grasped, relative movement between the light-shielding envelope and the carrier sheet is prevented. For development, the photographic film sheet is peeled away from the carrier sheet.

In the above described conventional film package, the gripping zone for withdrawal of the light-shielding envelope only is distinguished from that for removal of the whole film package. However, as the light-shielding envelope must be grasped at the designated zones in a predetermined sequence, handling of the conventional film package is rather cumbersome and, therefore, the photographer tends to mishandle it. According to conventional photographic film packages, the light-shielding envelope containing the exposed photographic film sheet is folded along a line extending transversely near the leading end section of the light-shielding envelope, and is sealed by an adhesive tape, so as to distinguish the exposed film package from unexposed film packages, as well as to prevent the exposed film sheet from being mistakenly re-exposed. However, is possible that the adhesive tape may become accidentally detached because of the resiliency of the light-shielding envelope.

Furthermore, it is possible that adhesive agent for detachably attaching the photographic film sheet to the carrier sheet may seep out from the end of the film sheet onto the photosensitive emulsion layer of the photographic film. In such a case, the photosensitive emulsion layer would be removed from the film base when the film sheet is peeled away from the carrier sheet. If the adhesive agent should extend to the end surface of the photographic film, a backing layer for preventing the film sheet from curling is also removed from the film base with the removal of the film sheet.

When the conventional film package is used in a dusty room or outside on a windy day, dust or particles tend to accumulate inside of the film holder. If there is dust or particles in the film holder, since the back surface of the film sheet uncovered from the light-shielding envelope will be in contact with the inner wall of the film holder, the dust or particles would adhere to the back of the film sheet, and would provide grazes on the film sheet when the film sheet is pushed into the light-shielding envelope.

As the film package is a disposable photographic film, the light-shielding envelope is made of carbon black filled paper material so as to reduce the cost of the film package. However, such a paper light-shielding envelope is not only insufficient in stiffness, but also would be curled or curved when stored in a damp room for a long time preventing smooth insertion of the film package into the film holder.

The above described light-locking clip is secured to the carrier sheet by caulking, but not to the degree that the light-locking clip will slip out of the carrier sheet when the light-shielding envelope is pulled out. Furthermore, the light-locking clip may be so deformed when caulked, that the open end edges thereof are too close to each other to arrest the light-locking clip in the film holder.

SUMMARY OF THE INVENTION

Accordingly, a primary object of this invention is to provide a photographic film package in which a film unit is securely grasped through a light-shielding envelope and is moved together with the light-shielding envelope when the film package is pulled out from a film holder.

Another object is to provide a photographic film package whose light-shielding envelope can be easily folded after photographing.

Still another object is to provide a photographic film package, of which a leading end section of a light-shielding envelope is strengthened.

A further object is to provide a photographic film package in which the withdrawal of only the light-shielding envelope is easily distinguishable from that of the whole film package, though either operation is performed by grasping an appropriate zone of the leading end section of the light-shielding envelope.

Yet another object is to provide a photographic film package which prevents a film unit from being weakened at the leading end thereof.

A still further object is to provide a photographic film package in which seeping or leakage of an adhesive agent onto a photosensitive emulsion layer of a photographic film sheet is prevented.

Another object is to provide a photographic film package in which the front surface of a photographic film sheet is visibly distinguishable from the back surface.

Still another object is to provide a photographic film package which is protected from dust and particles that may otherwise cause grazes in the photographic film sheet.

A further object is to provide a photographic film package in which a light-locking clip is securely attached to a carrier sheet without deforming an open end of the light-locking clip, and also the light-locking clip can tightly nip an open end of a light-shielding envelope through which a film unit is inserted and withdrawn.

A still further object is to provide a photographic film package which can be smoothly placed in a film holder.

Another object is to provide a photographic film package in which a light-shielding envelope need not be folded after photographing.

To achieve the above and other objects, a photographic film package of the present invention comprises a film unit consisting of a photographic film sheet and first and second carrier sheets detachably attached to opposite ends of the photographic film sheet. The second carrier sheet is formed with an opening or cut-out which extends transversely near the leading, or free, end of the second carrier sheet.

The opening indirectly serves as a finger grip for pulling the film package out of a film holder, and also facilitates folding of a leading end section of a light-shielding envelope. Since the stiffness of the film unit is reduced a the opening in the longitudinal direction of the film unit increases, it is preferable to provide another opening, cut-out, perforation or the like beside the first opening, while the first opening is exclusively used as the finger grip. The light-shielding envelope is attached with a reinforcement sheet at a leading end section thereof, so as to reinforce the leading end as well as to indicate the line along which the light-shielding envelope should be folded after photographing. The reinforcing sheet may be formed with an opening or cut-out for facilitating the gripping of the light-shielding envelope.

According to the present invention, because the second carrier sheet is provided at its leading end portion with an opening extending transversely of the film unit for allowing the inward facing surfaces of the light-shielding envelope to contact each other when the light-shielding envelope is grasped and pulled out, it is possible surely to pinch the film unit. Therefore, relative movement between the light-shielding envelope and the film unit is prevented when the film package as a whole is pulled out of the film holder. Furthermore, because the second carrier sheet can be bent along the above described opening, or a perforation line or a groove formed on the leading end portion thereof, it is easy to fold the leading end portion of the light-shielding envelope after exposure. Since the opening for grasping extends transversely, the film unit can be surely pinched by grasping the light-shielding envelope at an appropriate portion, if only the portion is in the leading end portion thereof. Furthermore, pulling the envelope alone is distinguishable from pulling of the whole film package by changing the degree of grasping force, so that the handling of the film package for photographing is easy. Because of the reinforcement sheet attached to the leading end portion of the light-shielding envelope, the stiffness of the leading end portion is improved. The cut-out formed in the reinforcement sheet and overlapping the opening, makes it possible to directly grasp the light-shielding envelope, thereby to ensure the grasping of the film unit.

According to a preferred embodiment of the present invention, the first and second carrier sheets are joined to the surface of the photographic film opposite to the photosensitive emulsion surface, by means of a weak adhesive agent. The adhesive agent is applied along both end edges of the film sheet, but extends over a shorter length than the length of the end edges, that is, the width of the film sheet, and leaves non-adhesive zones on the sides of both end edges, so that the adhesive agent will not seep onto the photosensitive emulsion layer of the film sheet. Therefore, it is possible to remove the film sheet from the first and second carrier sheets without damaging the film sheet. A hot-melt adhesive with reduced adhesive force is used as the adhesive agent.

According to a still preferred embodiment, at least a discrimination hole or cut-out is formed in the first and/or second carrier sheet for discriminating between the photosensitive emulsion surface and the other surface of the film sheet, so that it becomes possible to attach the first and second carrier sheets properly onto one side of the film sheet opposite to the photosensitive emulsion surface, even under a safe light.

The light-shielding envelope is provided with a removable adhesive tape, which is used to secure the light-locking clip to the light-shielding envelope after photographing, so as to prevent the light locking clip from slipping out of the light-shielding envelope. Visual information indicating that the film package is already exposed is adapted to appear when the adhesive tape is peeled. Therefore, it is possible to prevent the film sheet from mistakenly being re-exposed. A dusting tape for wiping the dust from the film sheet is disposed on an inward facing surface of the light-shielding envelope. Therefore, it is possible to avoid scratching of the film sheet by dust or particles disposed between the film sheet and the light-shielding envelope, which would otherwise be caused when the light-shielding envelope is pushed into the film holder. Because a smoothing layer is formed on the inward facing surface of the light-shielding envelope, the film unit can be smoothly slid in and out of the light-shielding envelope, and the film sheet is protected from becoming scratched. The light-locking clip is caulked such that bosses are formed on both inward facing surfaces of the light-locking clip that contact the carrier sheet. In this way, it is possible to tightly secure the light-locking clip to the carrier sheet without deforming the light-locking clip. Furthermore, assuming that the size of gap between the end edges of the light-locking clip is so defined that the gap is OH1 at both sides, OH2 at the center, and OH3 at middle points between the center and the respective sides, a preferable light-locking clip is provided when OH2 is equal or greater than OH1, whereas OH3 is less than OH2, which facilitates fitting of the light-shielding envelope into the light-locking clip, and ensures light-tight sealing of the light-shielding envelope.

The access opening of the light-shielding envelope has straight edge portions at opposite sides which extend parallel to the longitudinal direction of the clip, and a gently V-shaped edge in the intermediate portion. Furthermore, the transient portions from the middle V-shaped edge to the straight edge portions are beveled steeper than the middle V-shaped edge. In this way, the top and bottom edges of the access opening each have an escape portion from the caulking bosses, so that the straight edge portions, (i.e., the side portions of the access opening) are smoothly and tightly fitted into the recess of the clip. By expanding the escape portion toward both sides, it becomes possible to dispose the caulking points closer to both sides of the clip, which strengthens the joint between the clip and the carrier sheet.

BRIEF DESCRIPTION OF THE DRAWINGS

The above and other objects and advantages will become apparent from the following detailed description of the invention when read in conjunction with the accompanying drawings, wherein like reference numerals denote like elements, and wherein.

DESCRIPTION OF THE PREFERRED EMBODIMENT

Figure 1:
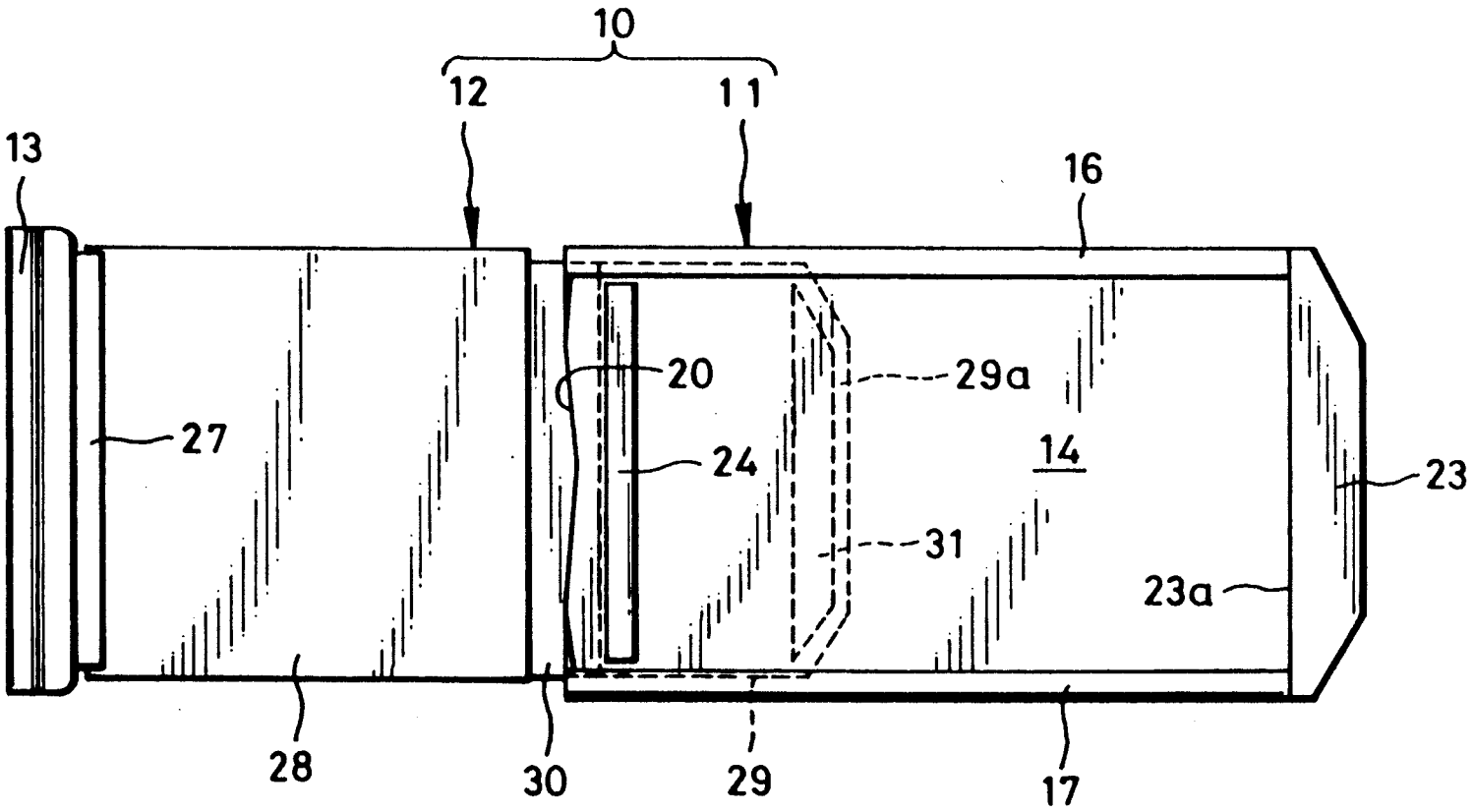
FIG. 1 is a plan view of a photographic film package, showing a photographic film sheet thereof withdrawn to a state at which the photographic film package is ready for photographing.
Figure 2:
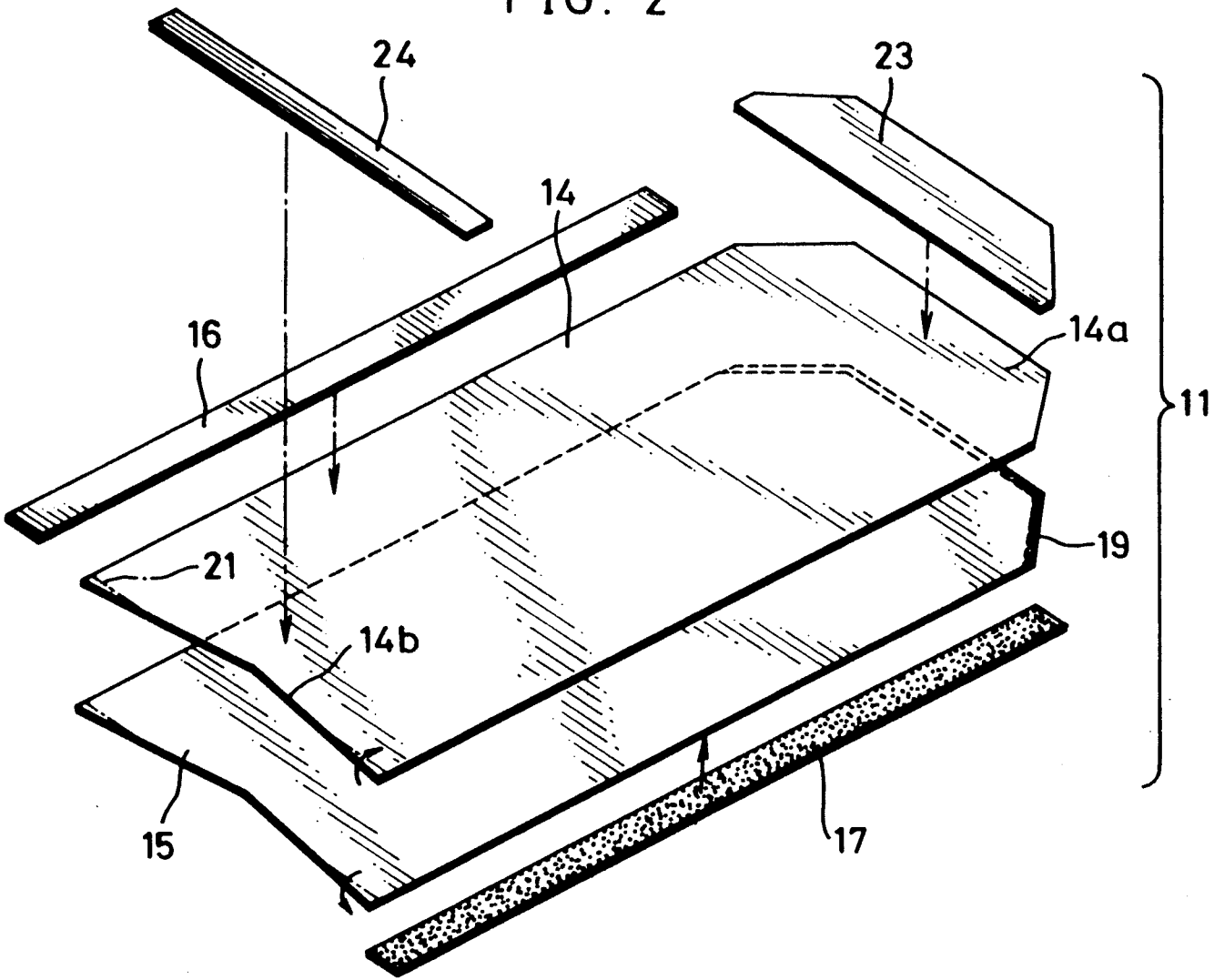
FIG. 2 is an exploded perspective view of a light-shielding envelope shown in FIG. 1.

In FIG. 1, a photographic film package 10 is constructed of a flat light-shielding envelope 11 and a film unit 12 enclosed in the light-shielding envelope 11 in light-tight fashion. If the light-shielding envelope were formed by folding a sheet material, the light-shielding envelope would be swelled at the center thereof because of the resiliency of the folded portions, so that the light-shielding envelope 11 could not be smoothly fitted into a light-locking clip 13. Referring also to FIG. 2, to prevent the swelling, the light-shielding envelope 11 comprises front and rear sheets 14 and 15 which are joined along their lateral edges by joining sheets 16 and 17 to provide a sleeve-like enclosure. The joining sheets 16 and 17 are applied with an adhesive agent such as hot-melt adhesive. The respective sheets 14 to 17 are made of black cardboard filled with carbon black so as to completely shield the interior of the light-shielding envelope from external light. The outward-facing surfaces of the front and rear sheets 14 and 15 are provided with a moisture-proof treatment, and may also have marks indicative of the pull-out direction and information such as the name of the maker printed thereon. The inward-facing surfaces of the front and rear sheets 14 and 15 are coated with a lubricating layer, or the like, for making the surfaces smooth, so that the film unit 12 smoothly slides on the surfaces during insertion and withdrawal thereof without the danger of being grazed.

As shown in FIG. 2, the leading end portion 14*a* of the front sheet 14 is beveled at its corners to form a trapezoid, in the same way as the rear sheet 15. An adhesive agent 19, such as hot-melt adhesive, is applied along the three side edges of the trapezoid of both the front sheet 14 and rear sheet 15. Trailing end 14*b* of the front sheet 14 is cut to form a slightly V-shaped edge, whose corners are outwardly folded down along a line 21 and are adhered to the outward-facing surface of the sheet 14. The trailing end of the rear sheet 15 is constructed in the same way as the front sheet 14. The folded ends form top and bottom margins of an access opening 20 of the light-shielding envelope 11 and contribute to reinforcing the access opening 20 as well as to allow the top and bottom margins to be smoothly received within the light-locking clip 13. It is to be noted that the adhesive agent 19 may be applied on either one of the sheets 14 and 15. A trapezoidal reinforcement sheet 23 is attached to the leading end portion 14*a* of the upper sheet 14, as illustrated in FIG. 2. The reinforcement sheet 23 helps to determine the line along which the light-shielding envelope 11 should be folded, as well as to reinforce the leading end section of the light-shielding envelope 11. A stopper tape 24 is disposed transversely on the outward-facing surface of the front sheet 14 near the trailing end 14*b*, so as to limit the position of the light-shielding envelope 11 in a film holder (not shown).

Figure 3:
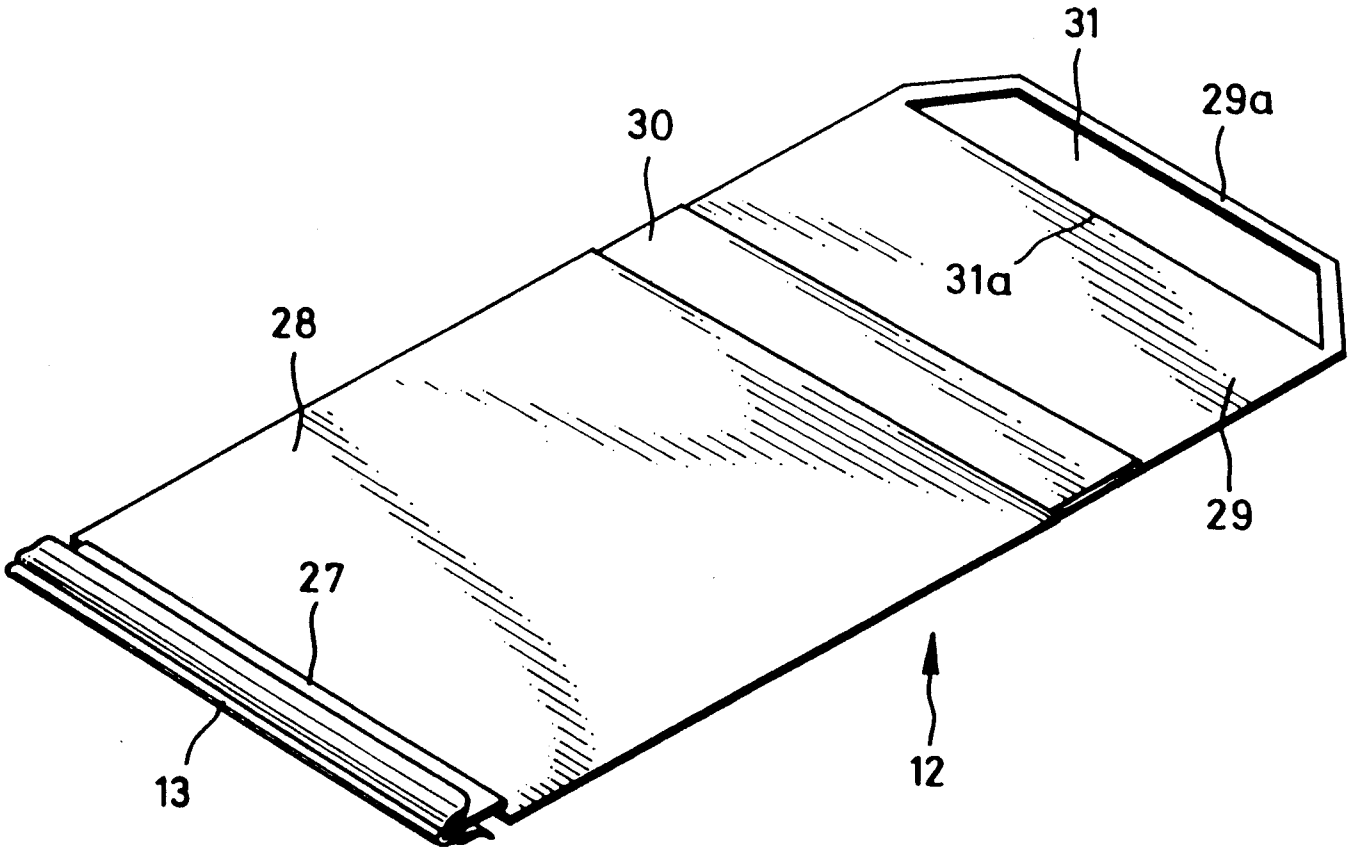
FIG. 3 is a perspective view of a film unit shown in FIG. 1.
Figure 5:
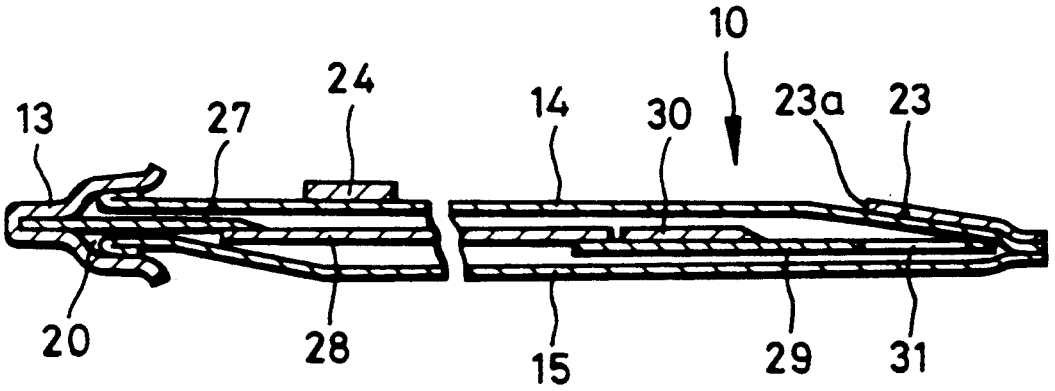
FIG. 5 is a cross-sectional view taken along line 5—5 of FIG. 4.
Figure 6:
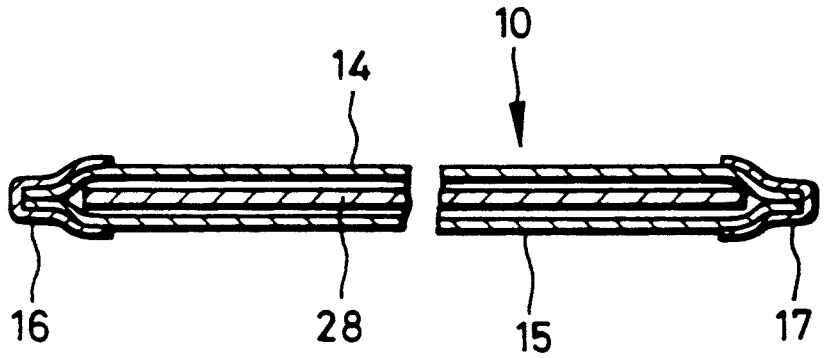
FIG. 6 is a cross-sectional view taken along line 6—6 of FIG. 4.

As described above, the film unit 12 is provided with the light-locking clip 13 for sealing the access opening 20 of the light-shielding envelope 11. The light-locking clip 13 is made of opaque resilient material such as, for example, black-colored metal plate or plastic resin. As shown in FIG. 3, the light-locking clip 13 is secured to a first carrier sheet 27 at the trailing end portion thereof. A photographic film sheet 28 is removable attached to the first and second carrier sheets 27 and 29, by means of an adhesive agent, e.g., hot-melt adhesive with a low bond strength. Specifically, the trailing end portion of the film sheet 28 is disposed under the leading end portion of the first carrier sheet 27, and the leading end portion of the film sheet is disposed over the trailing end portion of the second carrier sheet 29. The leading end of the first carrier sheet 27 tapers off in height to facilitate insertion of the film unit into the envelope. Further, a sheet 30 for compensating for the height-difference between the top surface of the film sheet 28 and that of the second carrier sheet 29 is mounted on the second carrier sheet 29, as shown in FIG. 5, so as to facilitate the sliding movement of the film unit 12 into and out of the light-shielding envelope 11. For the same reason, the leading end of the compensating sheet 30 also tapers off in height. These carrier sheets 27 and 29 are made of plastic resin material such as, for example, polyethylene.

Figure 4:
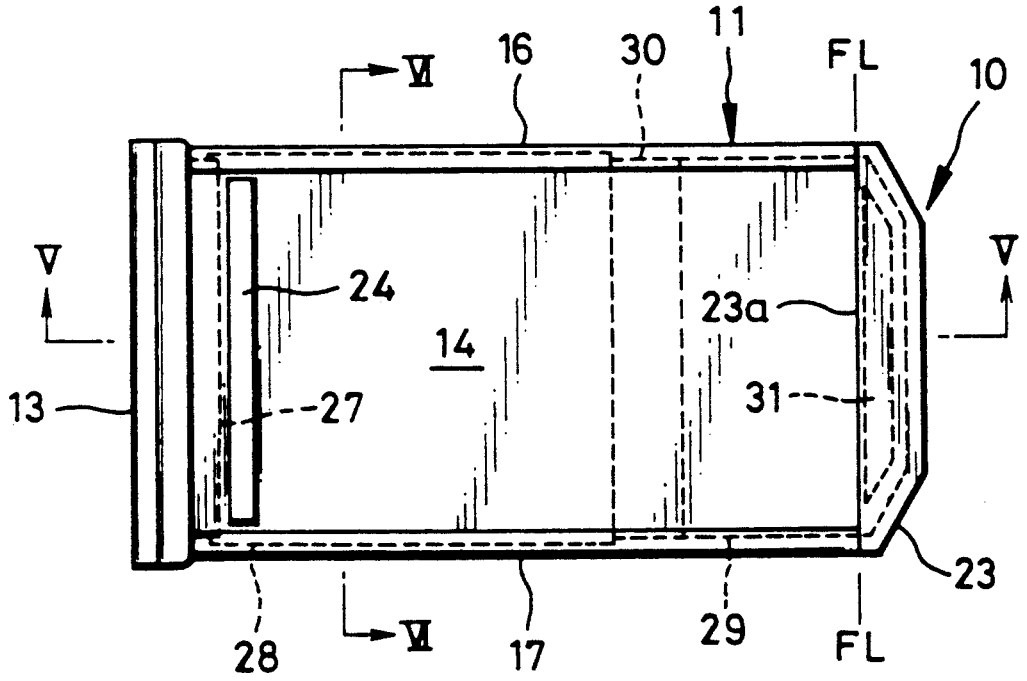
FIG. 4 is a plan view of the film package, showing the package in its fully assembled and closed condition.

The leading end portion of the second carrier sheet 29 is beveled at its corners corresponding to the leading end portion of the light-shielding envelope and is formed with an opening 31. When the light-shielding envelope 11 fully containing the film unit 12 is grasped, the inward-facing surfaces of the front and rear sheets 14 and 15 contact each other through the opening 31, so that the film unit 12 can be pulled out together with the light-shielding envelope 11 from the film holder. Furthermore, because there remains only a framed portion 29*a* in the leading end portion of the second carrier sheet 29, as shown in FIG. 3, it is easy to bend the second carrier sheet 29 along a line FL extending on a margin 31*a* of the opening 31 when the leading end portion of the film package 10 is folded after photographing, as shown in FIG. 4. Because the line FL is determined by the trailing edge 23*a* of the reinforcing sheet 23, it is desirable to position the trailing edge 23*a* in alignment with the margin 31*a* when the film unit 12 is fully enclosed in the light-shielding envelope 11. It is noted that the margin 31*a* is displaced from the photographic film sheet 28 so that the force applied to the second carrier sheet 29 for bending it along the margin 31*a* is not applied to the film sheet 28. Otherwise, the photographic image on the film sheet 28 could be damaged or fogged.

A photographic operation using the above described film package will now be described. Firstly, the film package 10 is in the condition shown in FIG. 4, wherein the film unit 12 is fully enclosed in the light-shielding envelope 11 whose access opening 20 is closed by the light-locking clip 13. The film package 10 in this condition is loaded into a film holder, such as described in U.S. Pat. No. 4,821,054. In loading, the film holder is in a released state and, thereafter, the film package 10 is inserted backward into the film holder with the light-locking clip 13 oriented forwardly. After the film package 10 is properly placed in the film holder, with a part of the reinforcement sheet 23 protruding from the film holder, the film holder is reset to a locked state, thereby arresting the light-locking clip 13 therein.

In this condition, when pulled by gently grasping the leading end section of the light-shielding envelope 11 through the reinforcing sheet 23, only the light-shielding envelope 11 is moved relative to the film unit 12 into the state a shown in FIG. 1. In this state, the film package 10 is ready for photographing because the film sheet 28 is disposed outside the light-shielding envelope 11. After photographing, the light-shielding envelope 11 is pushed into the film holder, thereby enclosing the film unit 12 again into the light-shielding envelope 11. Simultaneously, the access opening 20 of the light-shielding envelope 11 is fitted into the light-locking clip 13, so that the light-shielding envelope 11 is sealed from light, and thus the exposed photographic film sheet 28 is protected from ambient light.

Next, the lock of the film holder is released, and the whole film package 10 is removed from the film holder by tightly grasping and pulling the light-shielding envelope 11 by the reinforcing sheet 23. By grasping tightly, the inward-facing surfaces of the front and rear sheets 14 and 15 are brought into contact with each other through the opening 31, so that the film unit 12 is surely gripped, and thus is not moved relative to the light-shielding envelope 11 during the removal of the film unit 12.

Figure 7:
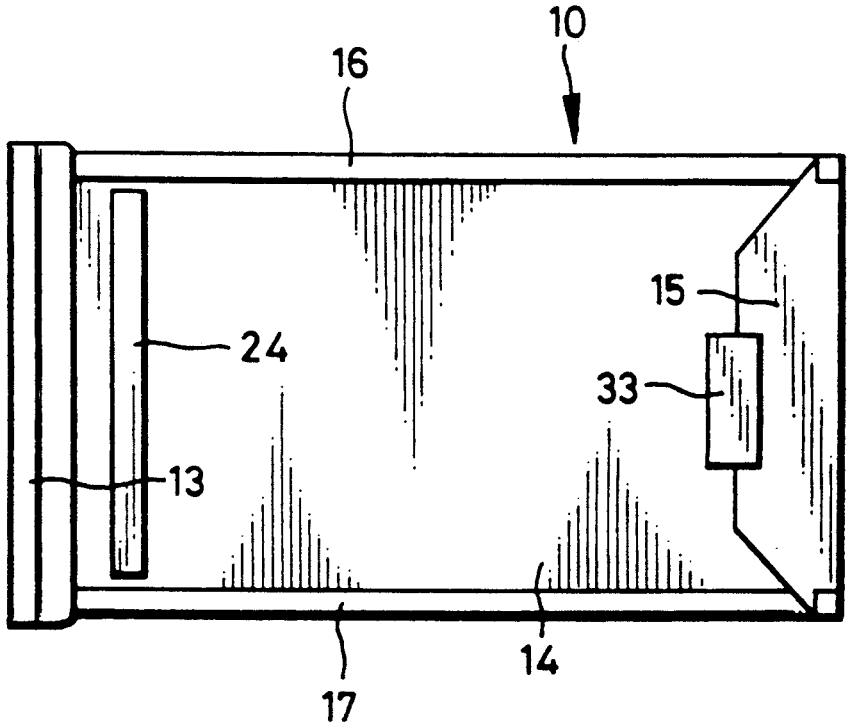
FIG. 7 is a plan view of the film package, showing the package with its leading end section folded after photographing.

In order to avoid an unintended removal of the light-locking clip 13 from the light-shielding envelope 11 that may be caused by movement of the film unit 12 within the light-shielding envelope 11, the leading end portion of the film package 10 is folded along the line FL extending on the margin 31*a* such that the reinforcing sheet 23 is brought into contact with the outward-facing surface of the front sheet 14. Thereafter, the folded leading end portion of the film package is affixed by an adhesive tape 33 to the front sheet 14, as shown in FIG. 7. Because the margin 31*a* is aligned with the trailing edge 23*a* of the reinforcing sheet 23, it is only necessary to fold the film package 10 along the trailing edge 23*a*, thereby bending the second carrier sheet 29 easily along the margin 31*a*. It is also possible to previously apply the adhesive tape 33 onto the light-shielding envelope. In such a case, the adhesive surface of the adhesive tape 33 should be covered by a release paper, which is peeled away from the adhesive tape 33 when the folded leading end portion of the light-shielding envelope 11 is adhered onto the adhesive tape 33.

For development, the light-shielding envelope 11 is unfolded after removing the adhesive tape 33. Next, the film unit 12 is pulled out of the light-shielding envelope 11 in a dark room, so as to remove the exposed photographic film sheet 28 from the first and second carrier sheets 27 and 29. The film sheet 28 is subjected to photographic processing and printing in a conventional manner.

Figure 8:
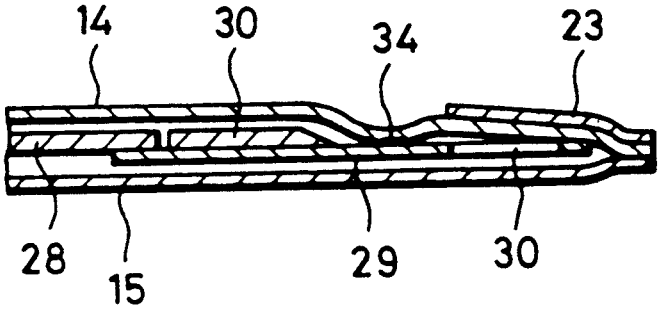
FIG. 8 is a cross-sectional view showing essential parts of a photographic film package according to another embodiment of the present invention, wherein a part of a second carrier sheet is gently adhered to a front sheet of a light-shielding envelope.

According to an embodiment shown in FIG. 8, the second carrier sheet 29 is partially adhered to the front sheet 14 by a hot-melt adhesive 34 with a low bonding strength. In this way the light-locking clip 13 of the film package 10 is prevented from slipping out of the light-shielding envelope 11 during shipment. The bonding strength of the hot-melt adhesive is sufficiently low that the light-shielding envelope 11 can be removed from the second carrier sheet 29 when an appropriate force is applied thereto in pulling direction. Therefore, no problem could arise in pulling out the light-shielding envelope from the film holder.

Figure 9:
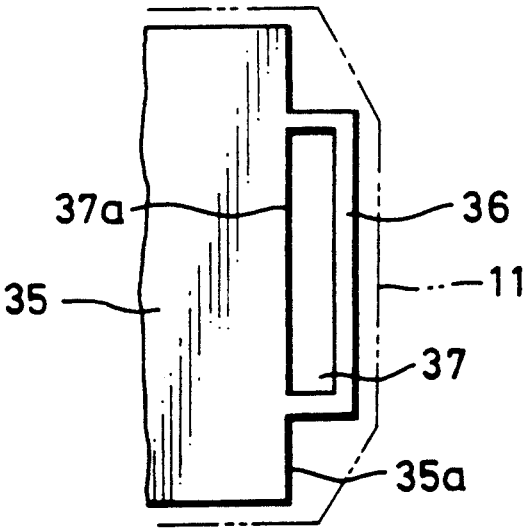
FIG. 9 is a fragmentary plan view of a photographic film package according to a further embodiment, wherein a second carrier sheet is formed with a rectangular lug projecting from the leading end.

According to an embodiment shown in FIG. 9, a second carrier sheet 35 has a rectangular lug projecting from the leading end 35*a* thereof. The rectangular lug is formed with a rectangular opening 37, leaving a slender framed portion 36. This embodiment facilitates bending of the second carrier sheet 35 along a margin 37*a* of the opening 37, because the margin 37*a* is aligned with the leading end 35*a*.

Figure 10:
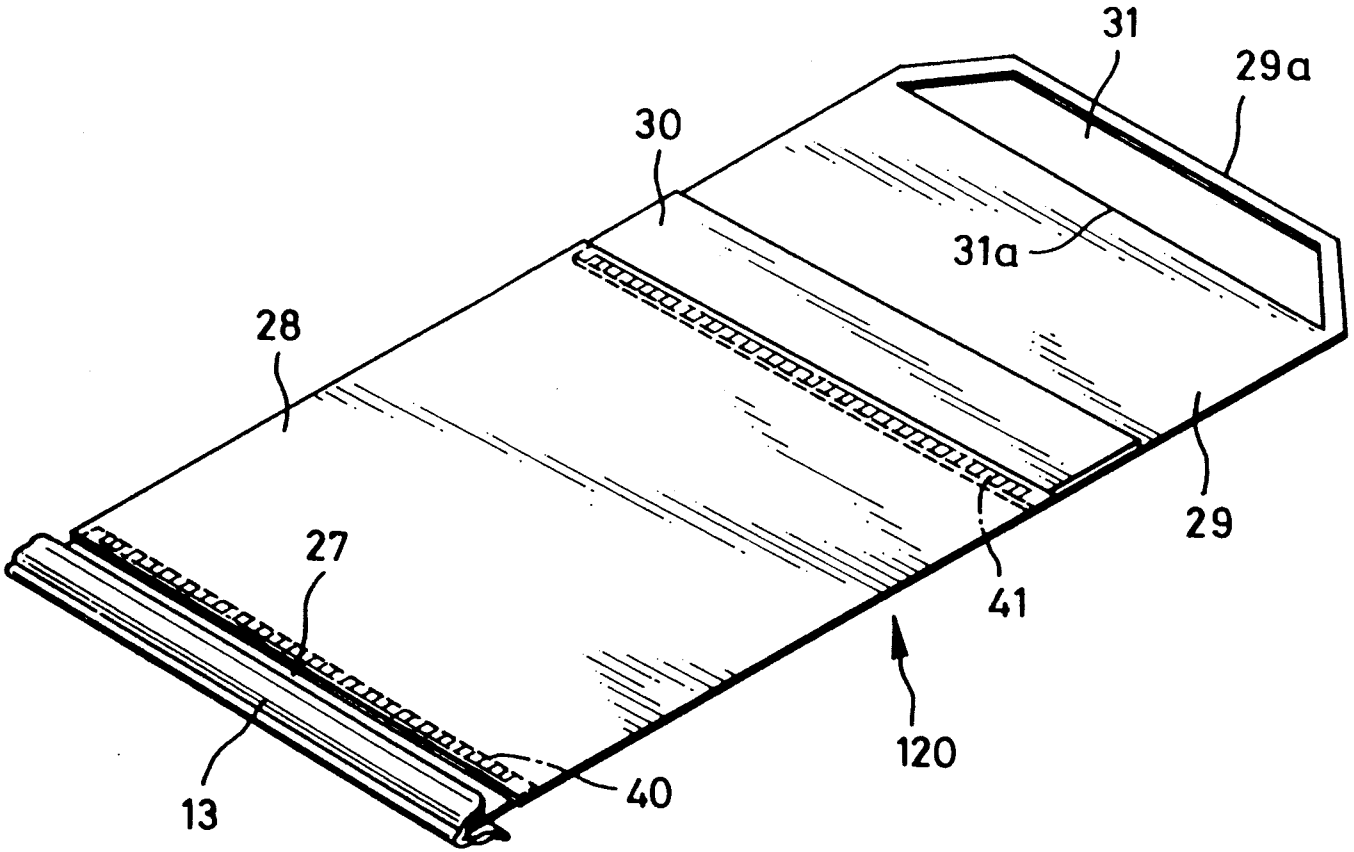
FIG. 10 is a cross-sectional view of a photographic film unit according to still another embodiment, wherein first and second carrier sheets are jointed to the back surface of a photographic film sheet.
Figure 11:
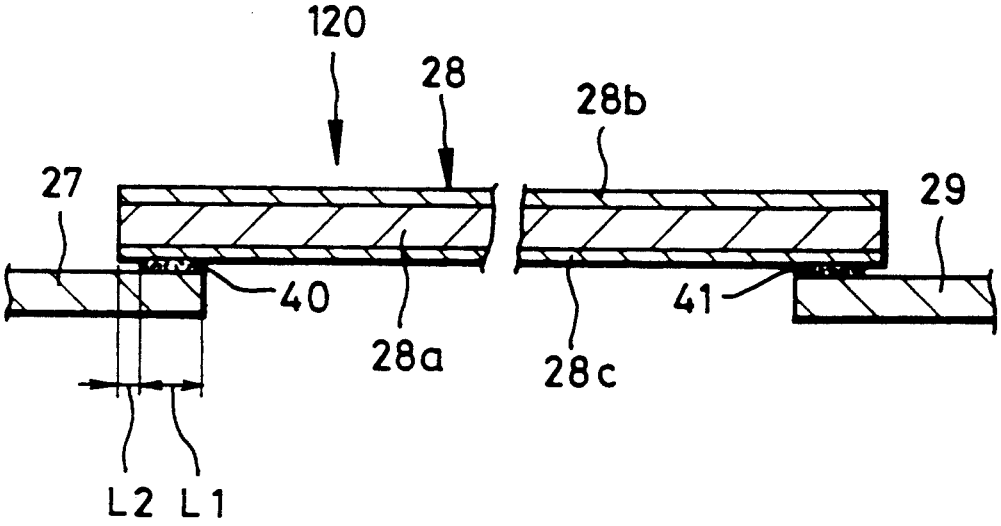
FIGS. 11 to 13 are cross-sectional views showing modifications of a joint portion between the film sheet and the carrier sheets.

FIGS. 10 and 11 shows a film unit 120 of another embodiment wherein first and second carrier sheets 27 and 29 are adhered to the back surface of a photographic film sheet 28. The film sheet 28 comprises a photosensitive emulsion layer 28*b* disposed on one side of a base sheet 28*a*, on the other side of which is disposed a backing layer 28*c* for preventing curling of the film sheet 28. The first and second carrier sheets 27 and 29 are removable attached to the backing layer 28*c* by an adhesive agent, such as hot-melt adhesives 40, 41. The hot melt adhesives 40 and 41 are applied as adhesive strips extending transversely along the leading edge of the first carrier sheet 27 and the trailing edge of the second carrier sheet 29. Each strip has a width L1, or extends by a length L1 in the longitudinal direction of the film unit 120. The length of each strip is set shorter than the width of the film sheet 28, so as to prevent the hot-melt adhesive 40 or 41 from spilling out of the side edges of the film sheet 28, as explained below. The joining zones between the film sheet 28, on one hand, and the respective carrier sheets 27 and 29, on the other hand, are bounded by chain-dotted lines and are provided with hatching in FIG. 10.

The strip-like hot-melt adhesives 40 and 41 are previously applied onto the leading and trailing end edges of the first and second carrier sheets 27 and 29, respectively. The film sheet 28 is superimposed at leading and trailing end portions thereof on the first and second carrier sheets 27 and 29 such that the backing layer 28*c* contacts the hot-melt adhesives 40 and 41, while leaving non-adhesive zones having a width L2 on both edges of the film sheet 28. That is, the adhesive strips 40 and 41 are placed at a distance L2 from the end edges of the film sheet 28, in the longitudinal direction of the film unit 120. Thereafter, when applied with pressure and heat by a sealer, the hot-melt adhesives 40 and 41 are melted, so that the film sheet 28 is removable adhered to the carrier sheets 27 and 29. Although the hot-melts adhesive 40 and 41 will spread when melted, the non-adhesive zone of width L2 will trap the spreading adhesive, thereby preventing the leakage of the adhesive from the film sheet 28. It is desirable to apply the heat to the side of the carrier sheets 27 and 29 when melting the hot-melt adhesives 40 and 41, because it reduces the amount of heat applied to the photosensitive emulsion layer 28*b*, and thus prevents thermal fogging of the photographic image.

It is proven that when the widths L1 and L2 are within the range 1.5 mm$\leqq$L1$\leqq$2.0 mm, 0$<$L2$\leqq$1.0 mm, respectively, the leakage of the hot-melt adhesive 40 or 41 can be prevented while the film sheet 28 can be reliably adhered to the carrier sheets 27 and 29. In the case of a photographic film sheet having no backing layer, the carrier sheets are adhered directly to a base sheet surface having no emulsion layer.

The adhesive agent applied in accordance with this embodiment will not overflow from the edge of the film sheet 28 onto the photosensitive emulsion layer 28*b*. The non-adhesive zones on the edges of the film sheet 28 also facilitate detachment of the film sheet 28 from the carrier sheets 27 and 29 for development. Since the hot-melt adhesives 40 and 41 are not applied to the emulsion layer 28*b*, the emulsion layer 28*b* will not be accidentally removed from the base sheet 28*a* when the film sheet 28 is detached from the carrier sheets 27 and 29. Further, since the carrier sheets 27 and 29 are attached to the outside of the backing layer 28*c*, and the base sheet 28*a* is present between the backing layer 28*c* and the photosensitive emulsion layer 28*b*, the photographic image on the emulsion layer 28*b* will not be adversely effected from fogging that may otherwise be caused by static which can be generated upon removal of the film sheet 28.

Figure 12:
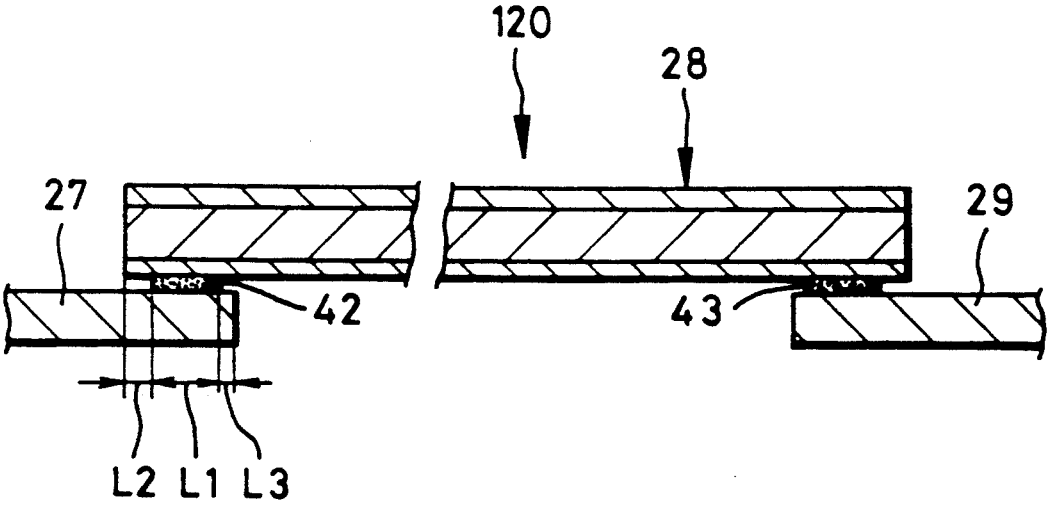

According to the above described embodiment, it is possible that the hot-melt adhesive may overflow from the edge of the carrier sheets 27 and 29 onto the backing layer 28*c*. Although the overflow adhesive remains on the backing layer 28*c* after removal of the carrier sheets 27 and 29, it does not influence the quality of the photographic image because the backing layer 28*c* is removed from the base sheet 28*a* by melting, prior to development. However, it is proven that the leakage of the hot-melt adhesive onto the backing layer 28*c* can be prevented by retracting the application area of hot-melt adhesive by a length L3 from the edge of the carrier sheet, as is shown by 42 and 43 in FIG. 12, wherein the length L3 is to be set within a range from 0 to 1.0 mm. Because the hot-melt adhesive is trapped in the non-adhesive zone of length L3, it is possible to prevent leakage of the adhesive from the edge of the carrier sheet.

Figure 13:
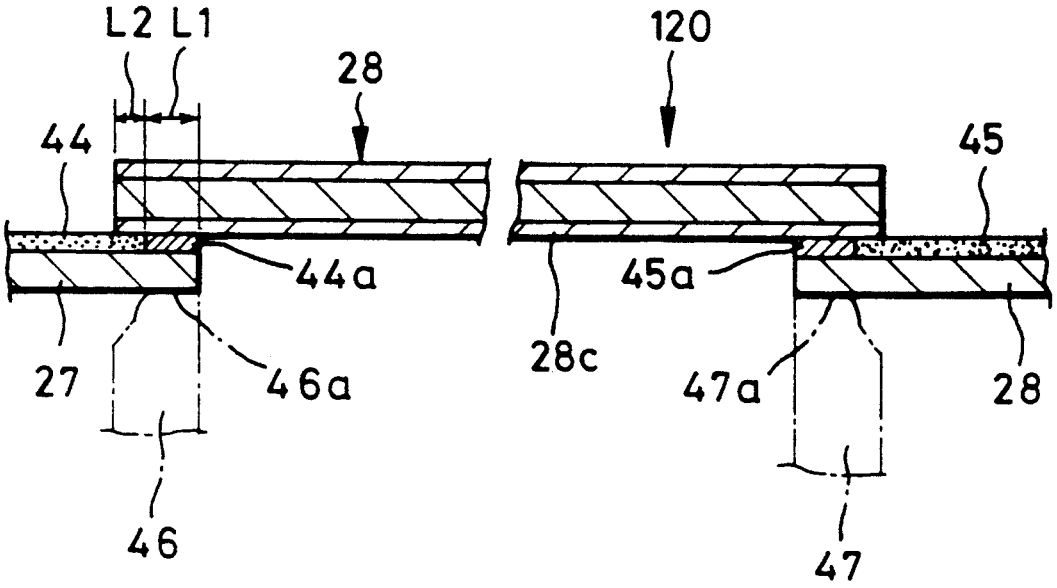

In an embodiment shown in FIG. 13, hot-melt adhesives 44 and 45 are applied onto the entire top surfaces of first and second carrier sheets 27 and 29. When adhering the carrier sheets 27 and 29 to a backing layer 28*c* of a film sheet 28, heaters 46 and 47 having respective narrow contact heating surfaces 46*a* and 47*a* having a width L1 each (as shown by chain-dotted line) are used to melt the hot-melt adhesives 44 and 45 at hot-melting zones 44*a* and 45*a* (designated by cross-hatching) such that non-adhered zones remain at opposite ends of the film sheet. As a result, the hot-melting zones 44a and 45a, each having the substantially same width L1, and the non-adhered zones, each having a width L2, are provided, as in the embodiment of FIG. 11.

Figure 14:
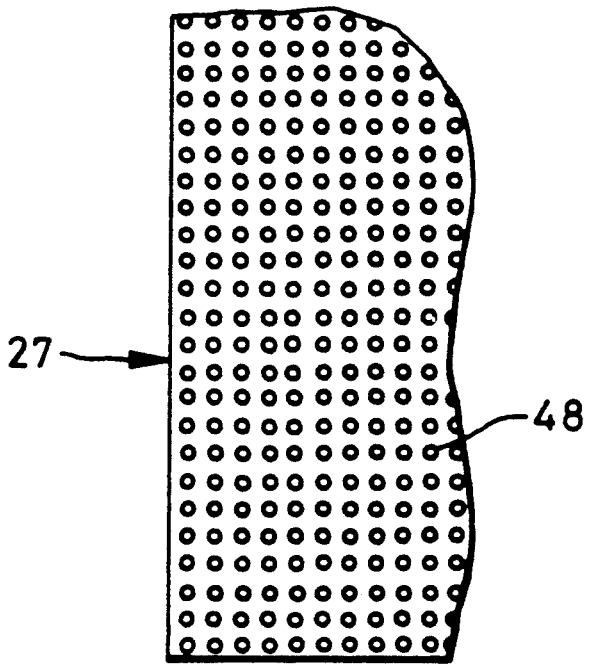
FIG. 14 is a plan view of a carrier sheet with a hot-melt adhesive applied by gravure printing.

As illustrated in FIG. 13, by rounding or cutting the corner of the contact heating surface 46a, 47a that is to be oriented toward the respective end edge of the film sheet 28, unnecessary melting of the hot-melt adhesives 44 or 45 beyond the end edge is prevented. In the case where hot-melt adhesive is to be applied onto the entire surface of the carrier sheet 27, 29, as in the embodiment of FIG. 13, it is preferable to apply the hot-melt adhesive in a dot pattern or a dot matrix pattern consisting of a large number of convex adhesive dots 48 as shown in FIG. 14, by means of photogravure printing. In this manner, even if too many hot-melt adhesive are melted, the amount of leakage of the hot-melt adhesive from the edge of the film sheet can be reduced. It is possible to obtain the same effect as for the above described gravure coating by providing grooves of depth 228 μm at a frequency of 45 lines per inch in the form of mesh.

FIGS. 15 to 18 show a photographic film package 49 according to another embodiment of the present invention, which facilities grasping of a film unit 121 through a light-shielding envelope 111, and has a stiffer leading end portion of the film unit 121 as compared with the above embodiments. The film package 49 has the substantially same construction as the above embodiments, with the exception of a reinforcement sheet 50 and a second carrier sheet 56. Therefore, the description of the same parts designated by the same reference numerals as the above embodiments will be omitted. The reinforcing sheet 50 is made of cardboard paper, and is shaped to form a trapezoid having a cut-out 51 in the middle of its bottom edge. Due to the cut-out 51, it is possible to tightly grasp the film unit 121 through the light-shielding envelope 111, so that the relative movement between the film unit 121 and the light-shielding envelope 111 is surely prevented when pulling out the film package 49 from a film holder. The cut-out 51 may be substituted by a bore large enough to pinch the light-shielding envelope 111 therethrough.

Figure 18:
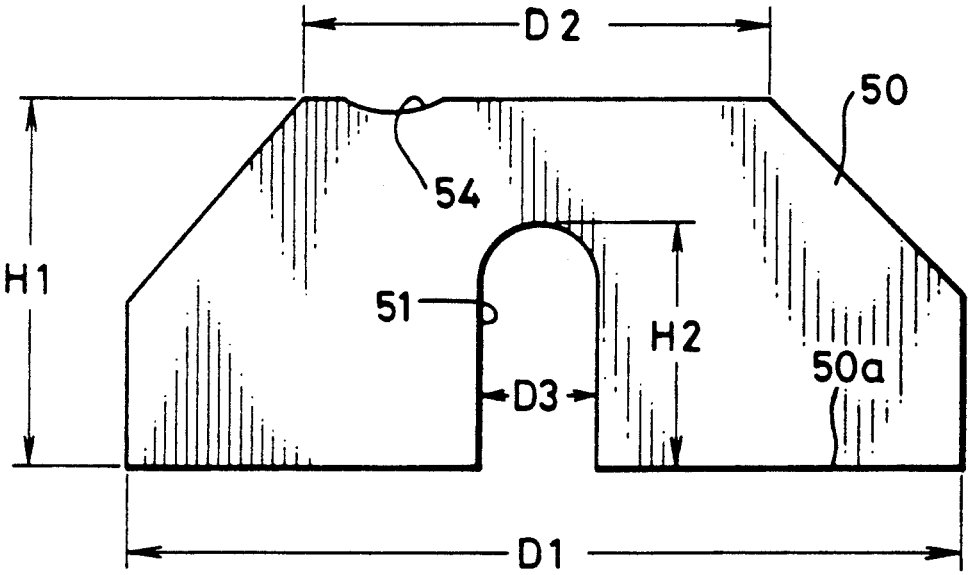
FIG. 18 is a plan view of a reinforcement sheet shown in FIG. 15.

As shown in FIG. 18, the dimensions of the reinforcement sheet 50, namely, the length of bottom side D1, the length of top side D2, the height H1, the height or depth H2 and the width of the cut-out D3, are preferably set within the following ranges, wherein all values are expressed in millimeter:

$100 \leq D1 \leq 111$
$55 \leq D2 \leq 61$
$11 \leq D3 \leq 19$
$40 \leq H1 \leq 45$
$34 \leq H2 \leq 39$ The lengths D1 and D2 are the same size as the width of the light-shielding envelope 111 at the same position, and more preferably, D1=110, D3=16, H1=43, and H2=37. Furthermore, the reinforcement sheet 50 may be made of synthetic resin material as well as cardboard paper. The thickness of the sheet 50 is from 0.1 to 0.5 mm, preferably 0.3 mm.

Figure 17:
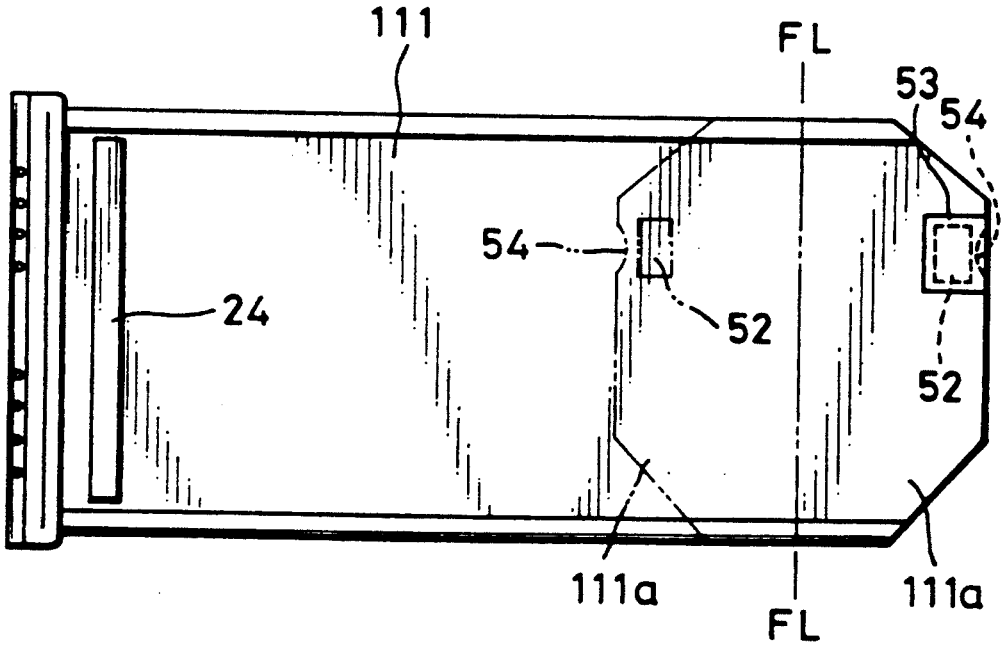
FIG. 17 is a bottom plan view of the film package of FIG. 15.

As shown in FIG. 17, a double-sided coated tape 52 (an adhesive layer on both sides) is applied to the light-shielding envelope 111 along the bottom surface of a leading end portion thereof, that is, at a leading end section of a rear sheet 15. A release paper 53 is removable adhered to the top surface of the double tape 52. The double tape 52 is used to secure the leading end portion of the light-shielding envelope 111 folded down along a line FL. A notch 54 is formed on the leading edge of the light-shielding envelope 111 at a joining part between the front sheet 14 and the rear sheet 15. One edge portion of the release paper 53 overlies the notch 54. In this way, the release paper 53 can be pinched at the edge to facilitate the peeling of the paper 53 from the double tape 52. It is to be noted that a stopper tape 24 is adhered to the back surface of the light-shielding envelope 111.

As described above, the film package 10 shown in FIGS. 1 to 7, is folded along the trailing edge 23a of the reinforcing sheet 23, thereby bending the film unit 12 along the margin 31a of the opening 31. Although it is preferable for the purpose of folding the light-shielding envelope 111 to define the region to be folded as large as possible, if the larger folding region has a large opening 31, the stiffness of the leading end portion of the second carrier sheet 29 would be lowered, and thus the leading end portion might accidentally bend when sliding the film unit 12 into and out of the light-shielding envelope 111. To solve this problem, according to the embodiment shown in FIGS. 15 to 18, the second carrier sheet 56 is formed with two openings of smaller size, and is thus improved in stiffness. That is, the second carrier sheet 56 has an opening 57 for pulling out the film unit 121 together with the light-shielding envelope 111, and an opening 58 to facilitate folding. In a fully closed condition of the film package 49 wherein a light-locking clip 13 seals an access opening 20 of the light-shielding envelope 121, the opening 57 crosswise overlaps the cut-out 51, and the trailing edge 50a of the reinforcement sheet 50 overlies the slender opening 58.

The second carrier sheet 56 is made of polyethylene sheet, but may be made of polyester resin sheet, polypropylene sheet, polystyrene sheet, polyamide sheet or other kinds of synthetic resin sheet as long as the sheet will not be broken when folded. The second carrier sheet 56 preferably ranges from 0.10 mm to 0.25 mm thick. Because the light-shielding envelope 111 sufficiently shields the carrier sheet 56 from ambient light, it is unnecessary to make the carrier sheet 56 opaque by coloring. In view of cost, the transparent carrier sheet 56 is preferable to a colored one.

The film package 49 of the just described embodiment is also loaded in a film holder for photographing. Thereafter, the film package 49 is removed from the film holder by tightly grasping the light-shielding envelope 111 at the cut-out 51 and pulling it out of the film holder. Then, the release paper 53 is removed from the double-coated tape 52 by pinching the edge of the paper 53 overlying the notch 45. Thereafter, the light-shielding envelope 111 is folded along the trailing edge 50a of the reinforcing sheet 50 down to the double-coated tape 52, so that the leading end portion 111a of the light-shielding line FL extending on the slender opening 58.

Figure 19A:
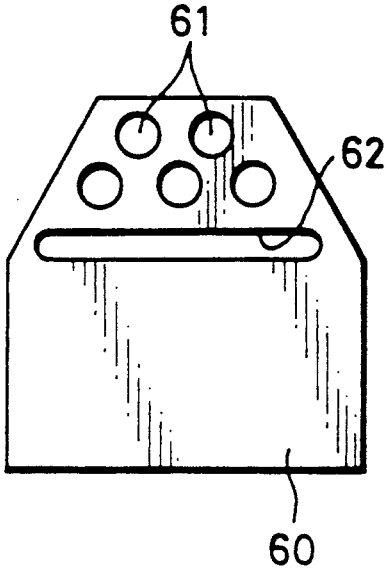
FIGS. 19A to 19D show modifications of a second carrier sheet.
Figure 19B:
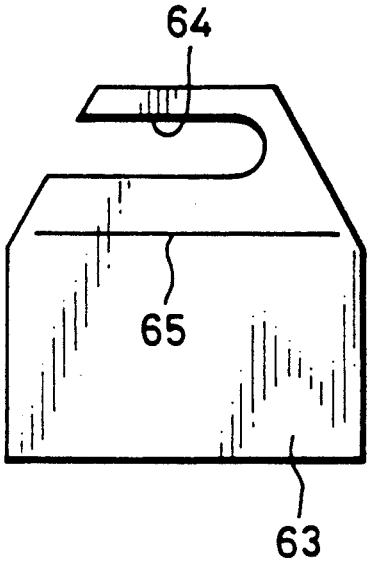
Figure 19C:
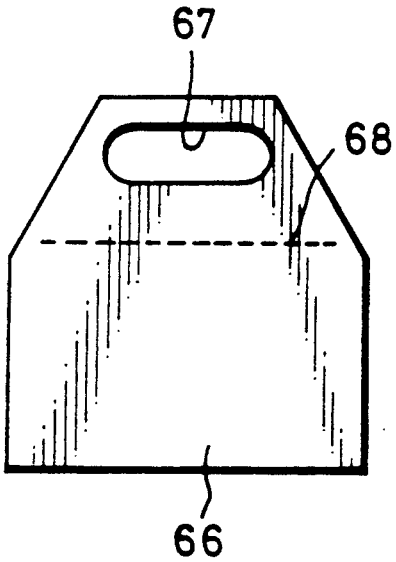
Figure 19D:
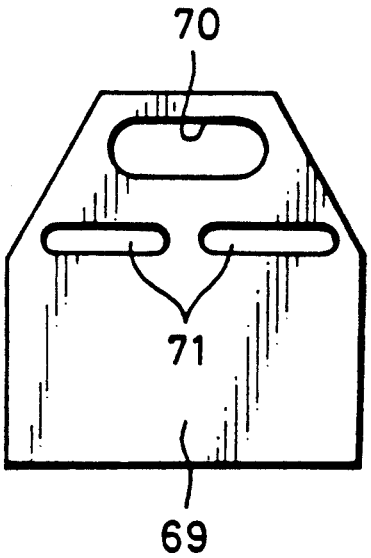

FIGS. 19A to 19D show other modifications of second carrier sheet. In the second carrier sheet 60 of FIG. 19A, a plurality of small bores 61 are formed so as to facilitate pinching of the second carrier sheet 60. A slender opening 62 is provided to facilitate folding of the sheet 60. The second carrier sheet 63 of FIG. 19B is formed with a cut-out 64 for grasping and a groove 65 to facilitate folding. The second carrier sheet 66 of FIG. 19C is formed with an opening 67 for grasping and a perforation line 68 to facilitate folding. The second carrier sheet 69 of FIG. 19D is formed with an opening 70 for grasping and a pair of openings 71 to facilitate folding. It may be possible to provide more than one groove 65 or perforation line 68 disposed adjacent to each other.

FIGS. 20 to 22, 23A and 23B illustrate an embodiment which makes it possible to discriminate a photosensitive emulsion surface of a film sheet in manufacturing a film package 72. Furthermore, in order to prevent a light-locking clip from slipping away from a light-shielding envelope, the light-locking clip is secured to the light-shielding envelope by means of an adhesive tape after photographing, instead of folding the leading end portion of the light-shielding envelope. The construction of the film package 72 other than the second carrier sheet 73 of a film unit 122 is substantially the same as the film package of FIG. 15. The second carrier sheet 73 is formed in its leading end portion with a discrimination hole 75 and a pair of positioning holes 76*a* and 76*b* as well as an opening 74 for grasping. The detection hole 75 is used to discriminate the photosensitive emulsion surface of a film sheet 28 from the backing surface when assembling the film unit 122 under safe light. The positioning holes 76*a* and 76*b* are used to properly position the second carrier sheet 73 during manufacturing. Although the positioning holes 76*a* and 76*b* are disposed on opposite sides of a longitudinal center line 77 of the film unit 122, it is possible to dispose them on the same side of the center line 77. A first carrier sheet 27 is also formed with a hole 78 for discriminating the photosensitive emulsion surface.

It is also possible to provide at least a discrimination hole in either the first or second carrier sheet. Furthermore, it is possible to provide a notch 79 instead of the holes 75 and 78. The holes 75 and 78 may be of another shape than circular, e.g., oval, rectangular, square, triangular, etc.

Figure 20:
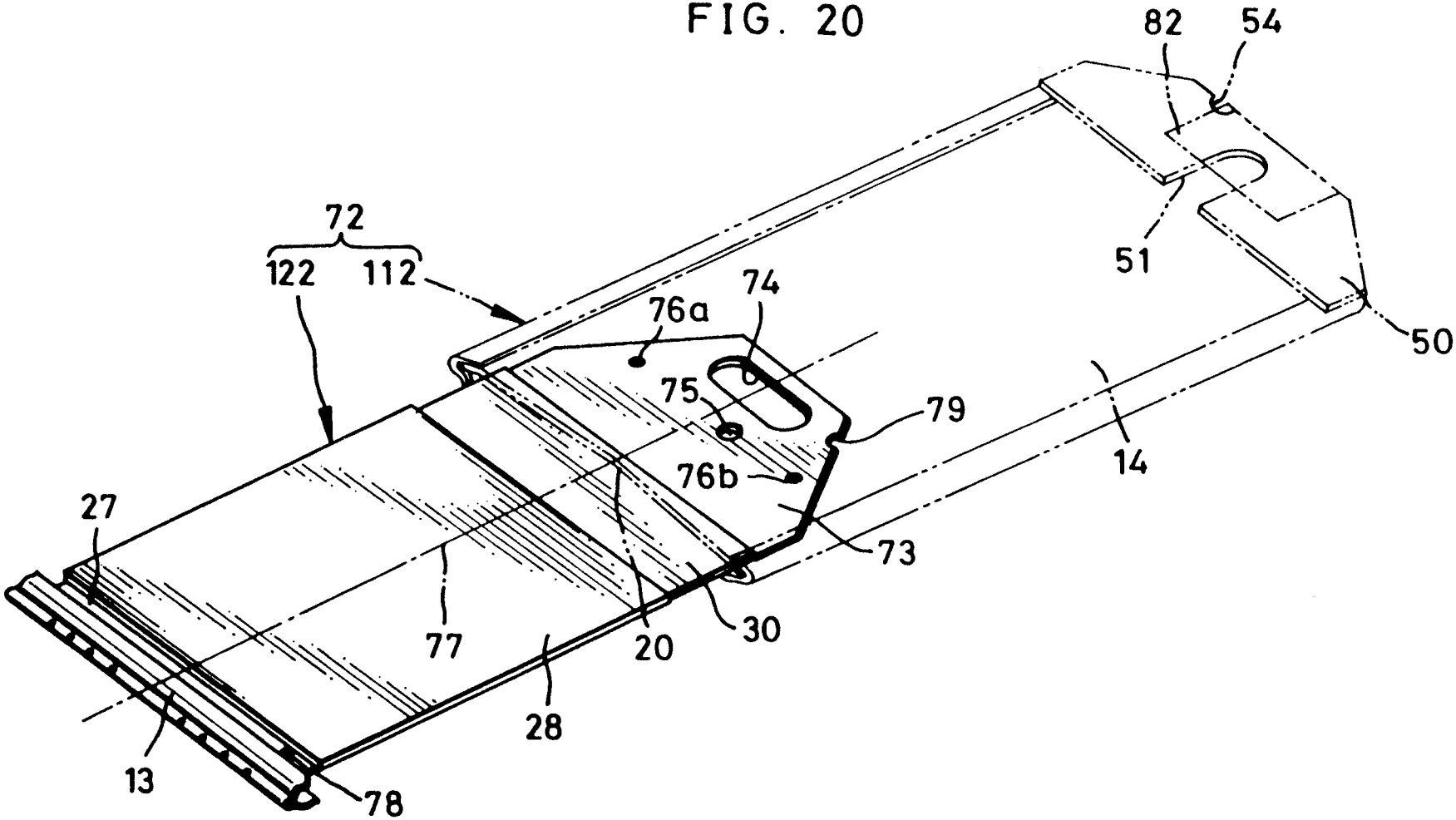
FIG. 20 is a perspective view of a photographic film package according to a still further embodiment, wherein a light-locking clip is secured to a light-shielding envelope by an adhesive tape, and wherein the light-shielding envelope is shown by chain-dotted line.

The first and second carrier sheets 27 and 73 can be joined to the backing surface of the film sheet 28 by hot-melt adhesive at proper positions, with reference to the discrimination holes 75 and 78 and the positioning holes 76*a* and 76*b*, under safe light. Furthermore, it is possible to discriminate the emulsion surface from the backing surface of the film sheet 28 with reference to the discrimination holes 75 and 78 so that the film unit 122 can be inserted properly into a light-shielding envelope 112. Although there is formed a single opening 74 for grasping of the film unit 122 in this embodiment, it is possible to provide a plurality of small bores as shown in FIG. 19A, or a cutout as shown in FIG. 19B. The discrimination holes as shown in FIG. 20 may be provided in the fold-type film packages shown in FIGS. 1 to 19D.

According to the embodiments shown in FIGS. 1 to 19D, the leading end portion of the light-shielding envelope is folded down to prevent movement of the exposed film unit relative to the light-shielding envelope. However, it is possible that the film unit can be moved relative to the light-shielding envelope upon folding. As a result, a small undesirable gap would be disposed between the light-shielding envelope and the light-locking clip. To prevent such a problem, it is preferable to secure the light-locking clip to the light-shielding envelope by means of an adhesive tape without folding the light-shielding envelope. Therefore, in the film package 72 of FIGS. 20 and 21, a double-layer tape 82 is applied to the back surface of the light-shielding envelope 112, that is, the outward facing surface of a rear sheet 15 of the light-shielding envelope 112, at a leading end portion thereof such that a corner of the tape 82 overlies a notch 54. The double-sheet tape 82 is 15 mm in width, and 40 mm in length, for instance.

Figure 22:
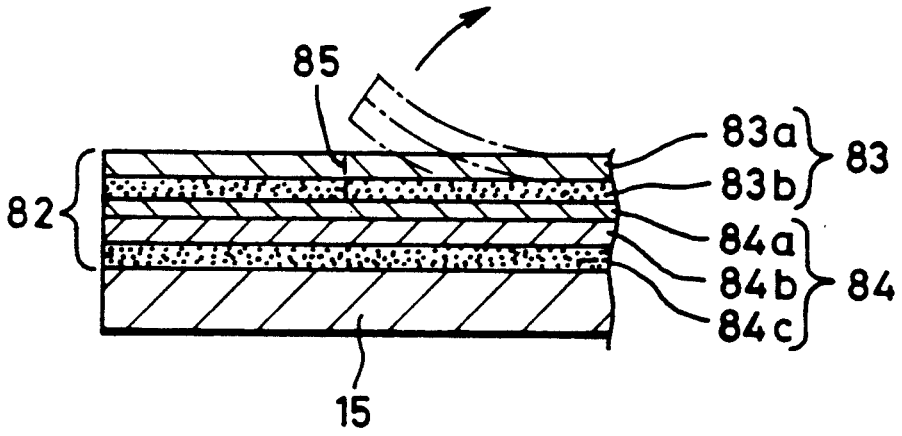
FIG. 22 is a sectional view showing the adhesive tape constructed as a double tape.

As shown in FIG. 22, the double-sheet tape 82 comprises an outside tape 83 and an inside tape 84. The outside tape 83 consists of a quality paper 83*a* of 73 g/m$^2$ weight and a re-adhesive acrylic adhesive layer 83*b* applied on the bottom surface of the paper 83*a*. The inside tape 84 consists of a quality paper 84*b*, to the top surface of which a transparent polyester film 84*a* is cemented, and an acrylic adhesive layer 84*c* applied to the bottom surface of the paper 84*b*. The outside tape 83 is removable attached to the inside tape 84 by the acrylic adhesive layer 83*b*, while the inside tape 84 is fixedly attached to the rear sheet 15 of the light-shielding envelope 112 by the acrylic adhesive layer 84*c*. On the top surface of the paper 84*b* of the inside tape 84 are printed characters "exposed", which appear when the outside tape 83 is peeled off.

In order to facilitate removal of the outside tape 83 from the inside tape 84, the top surface of the polyester film 84*a* is coated with silicone, and the outside tape 83 is cut along a line 85 spaced by a distance of 35 mm from an edge of the inside tape 84. When the double-sheet tape 82 is bent, the inside tape 84 alone is bent, but the outside tape 83 will not be bent because of the cut line 85, so that the acrylic adhesive layer 83*b* is removed from the polyester film 84*a* in the area of the cut line, thereby facilitating removal of the outside tape 83. Although the cut line 85 is formed parallel to a short side edge of the tape 82, it is possible to provide a cut line diagonally in a corner of the outside tape 83.

Figure 23A:
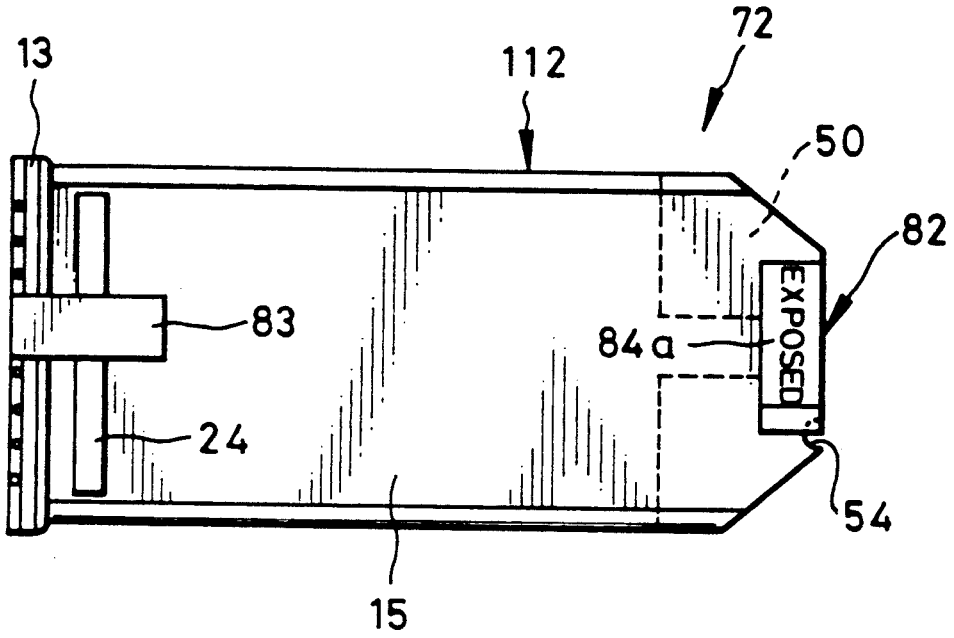
FIGS. 23A and 23B show modifications of the photographic film package of FIG. 20 in the bottom plan views, showing various applying conditions of an upper tape which is peeled from the double tape.
Figure 23B:
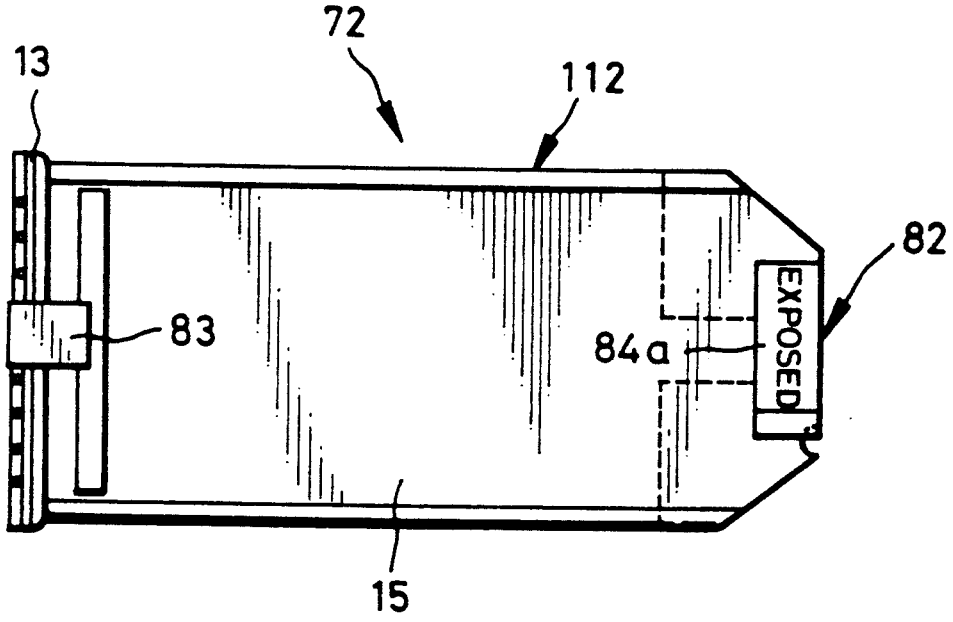

The operation of the film package 72 will now be described. The film package 72 is pulled out of the film holder after exposing the film sheet 28 in the same way as described above. Next, the double-sheet tape 82 is bent at a portion overlying the notch 54, and the acrylic adhesive layer 83*b* is partially removed from the polyester film 84*a* along the cut line 85, so that the user can easily peel the outside tape 83 without the need for scratching it. When the outside tape 83 is removed, the printed characters "exposed" appears on the inside tape 84, so that the film package 72 may not be re-exposed. The outside tape 83 is thereafter adhered to the film package, extending from the light-shielding envelope 112 to the light-locking clip 13 so as to secure the light-locking clip 13 to the light-shielding envelope 112, in a manner as shown in FIG. 23A or 23B. In FIG. 23A, the outside tape 83 is attached to one side of the light-shielding envelope 112 and the light-locking clip 13, whereas the outside tape 83 is attached to the opposite sides of the light-shielding envelope 112 through the light-locking clip 13 in FIG. 23B. As a modification of this embodiment, it may be possible to attach a single-sheet removable re-adhesive tape directly to the light-shielding envelope 112, such that the characters "exposed" previously printed on the light-shielding envelope 112 appear when the re-adhesive tape is peeled off to be used for securing the light-locking clip 13 to the light-shielding envelope 112. The just described method of securing the light-locking clip to the light-shielding envelope instead of folding the light-shielding envelope may be applied to the film units shown in FIGS. 3, 10 and 15.

Figure 21:
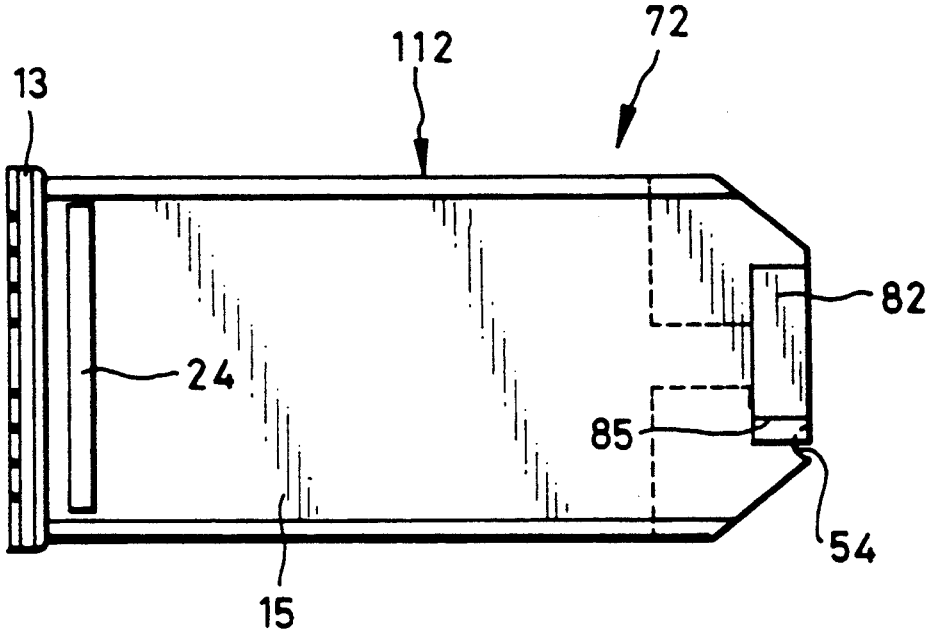
FIG. 21 is a bottom plan view of the film package shown in FIG. 20.
Figure 24A:
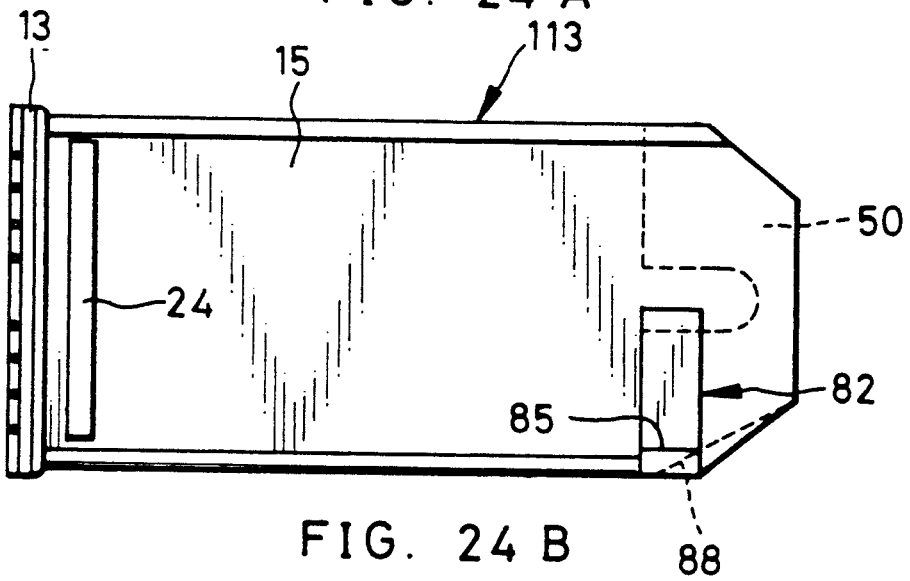
FIG. 24A to 24C show modifications of the photographic film package in bottom plan views, showing modifications of the double tape applying position.
Figure 24B:
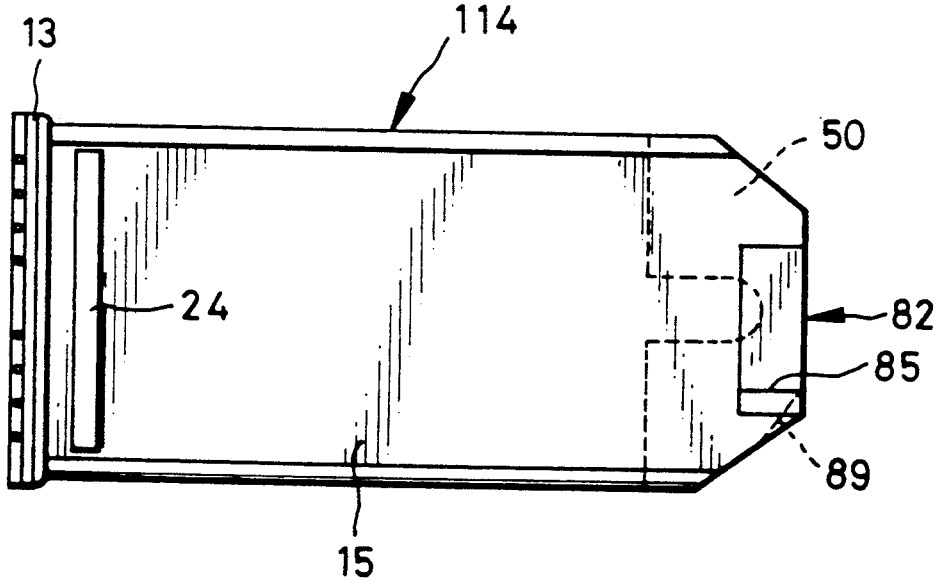
Figure 24C:
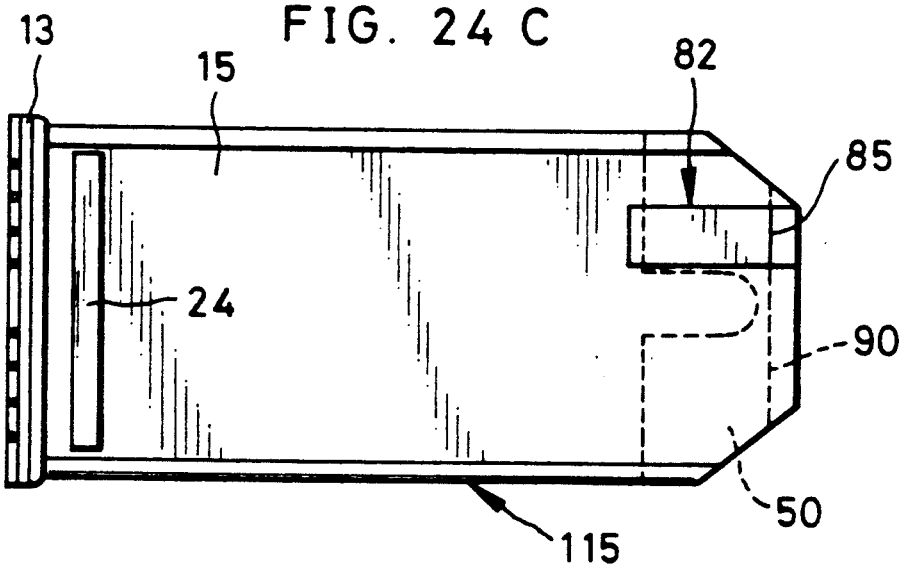

FIGS. 24A to 24C show modifications of a reinforcement sheet each which has a cut-off portion formed on one edge thereof instead of the notch 54, wherein like parts are designated by the same reference numerals as the embodiment shown in FIGS. 20 to 22. In a light-shielding envelope 113 of FIG. 24A, a trapezoidal reinforcement sheet 50 is cut off from a bevel edge to a side edge so as to form another bevel edge 88. A double-sheet tape 82 is applied on the opposite side of the reinforcement sheet 50 indirectly across the bevel edge 88. In order to remove an outside tape 83 of the double-sheet tape 82, the light-shielding envelope 113 is slightly bent along the bevel edge 88, so that the outside tape 83 is partially peeled off along a cut line 85. In the light-shielding envelope 114 of FIG. 24B, a trapezoidal reinforcement sheet 50 is cut off from a top edge to a bevel edge so as to form another bevel edge 89, along which the light-shielding envelope 114 is forwardly bent for removal of an outside tape of a double-sheet tape 82. The double-sheet tape 82 is applied on the opposite side of the reinforcement sheet 50 indirectly across the bevel edge 89. In a light-shielding envelope 115 of FIG. 24C, a trapezoidal reinforcement sheet 50 is cut off at the top portion along a line parallel to the top edge so as to form an edge 90.

Next, an adhesive agent used to removable adhere the film sheet to the first and second carrier sheets will be described in detail. The adhesive agent is, for example, a hot-melt adhesive having a composition as shown in formulation of table 1.

TABLE 1

| COMPOSITIONS | PROPORTION (A) wt % | PROPORTION (A) wt % |
|---|---|---|
| EAV resin | 30–70 | 40–60 |
| SBR | 4–20 | 6–15 |
| rosin tackifier | 4–25 | 6–18 |
| chlorinated polyethylene resin | 6–20 | 8–15 |
| modified amide resin | 4–15 | 6–10 |
| wax | 1–10 | 2–6 |
| anti-oxidant | 0.01–2.0 | 0.1–1.0 |
| silica | 0.1–8 | 0.5–5 |

The respective components themselves are known to the art, but an adhesive agent preferable for joining the film sheet will be provided by determining the proportion of these components, for instance, as shown in the table 1, wherein (A) is a preferred example, and (B) is a more preferred example of the proportion expressed in percent by weight.

According to the present embodiments, the hot-melt adhesive has the following composition:

EAV resin: 48 wt %
SBR: 10 wt %
rosin tackifier: 14 wt %
chlorinated polyethylene resin: 14 wt %
modified amide resin: 8 wt %
wax: 4 wt %
anti-oxidant: 0.5 wt %
silica: 1.5 wt %

The hot-melt adhesive of the above composition has a low bond strength and a low temperature sealing property, so that it is excellent in preventing thermal fogging which might be produced on the film sheet by a hot-melting process, and in having both appropriate adhesion strength and release properties despite the fact that these properties contradict each other. In this embodiment, the thickness of hot-melt adhesive layers applied to the first and second carrier sheets are 5 μm and 10 μm, respectively. A preferable range of the thickness of hot-melt adhesive layers is from 3 to 30 mm, and more preferably from 5 to 15 μm.

Figure 15:
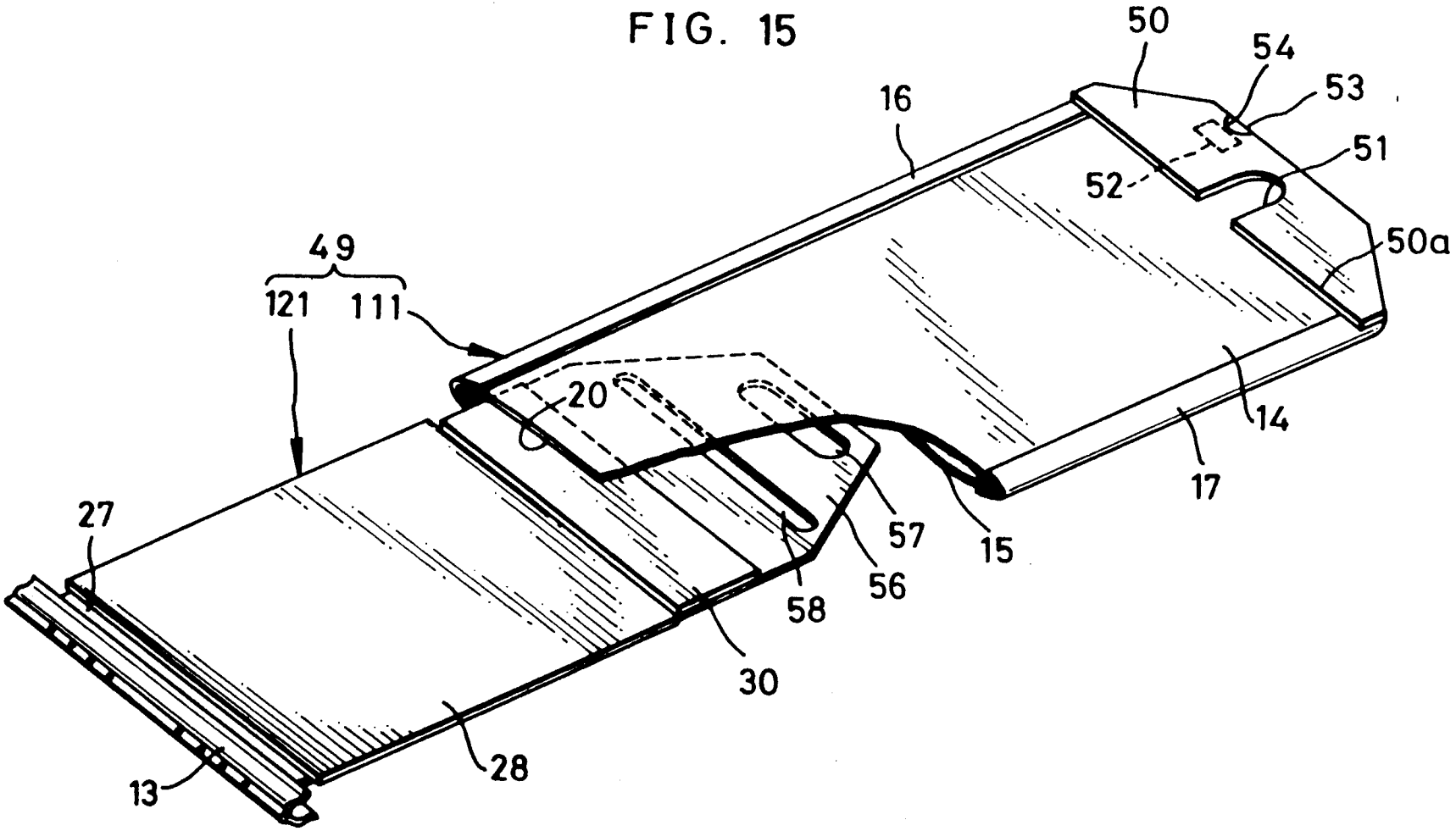
FIG. 15 is a perspective view of a photographic film package according to another embodiment.
Figure 16:
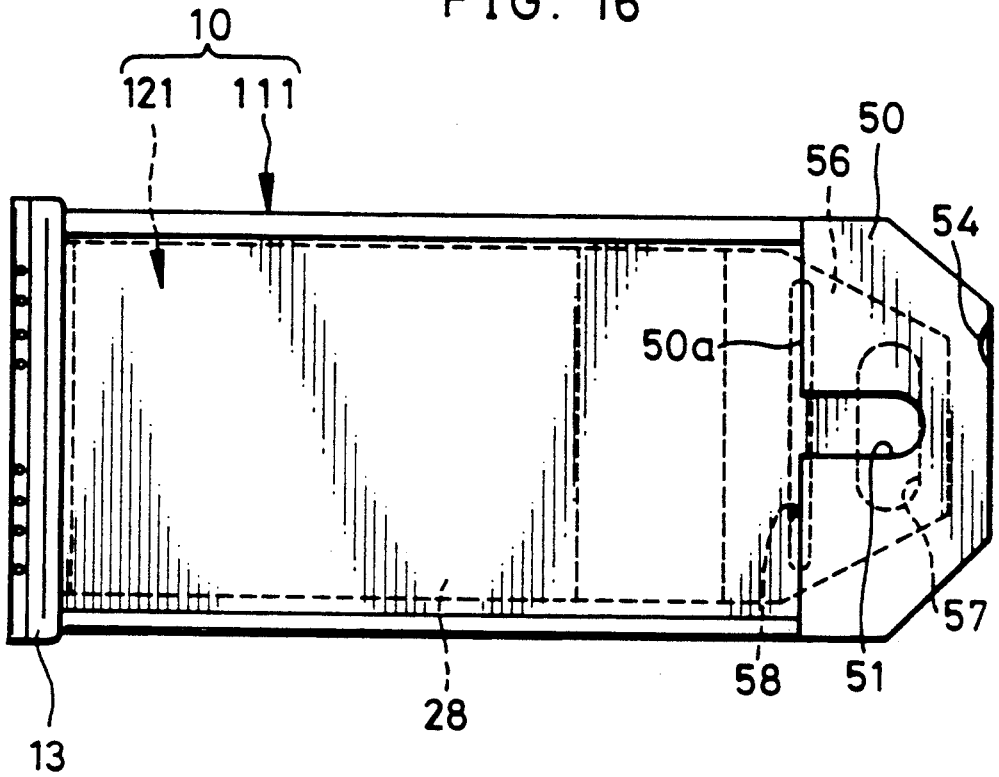
FIG. 16 is a top plan view of the film package of FIG. 15.
Figure 25:
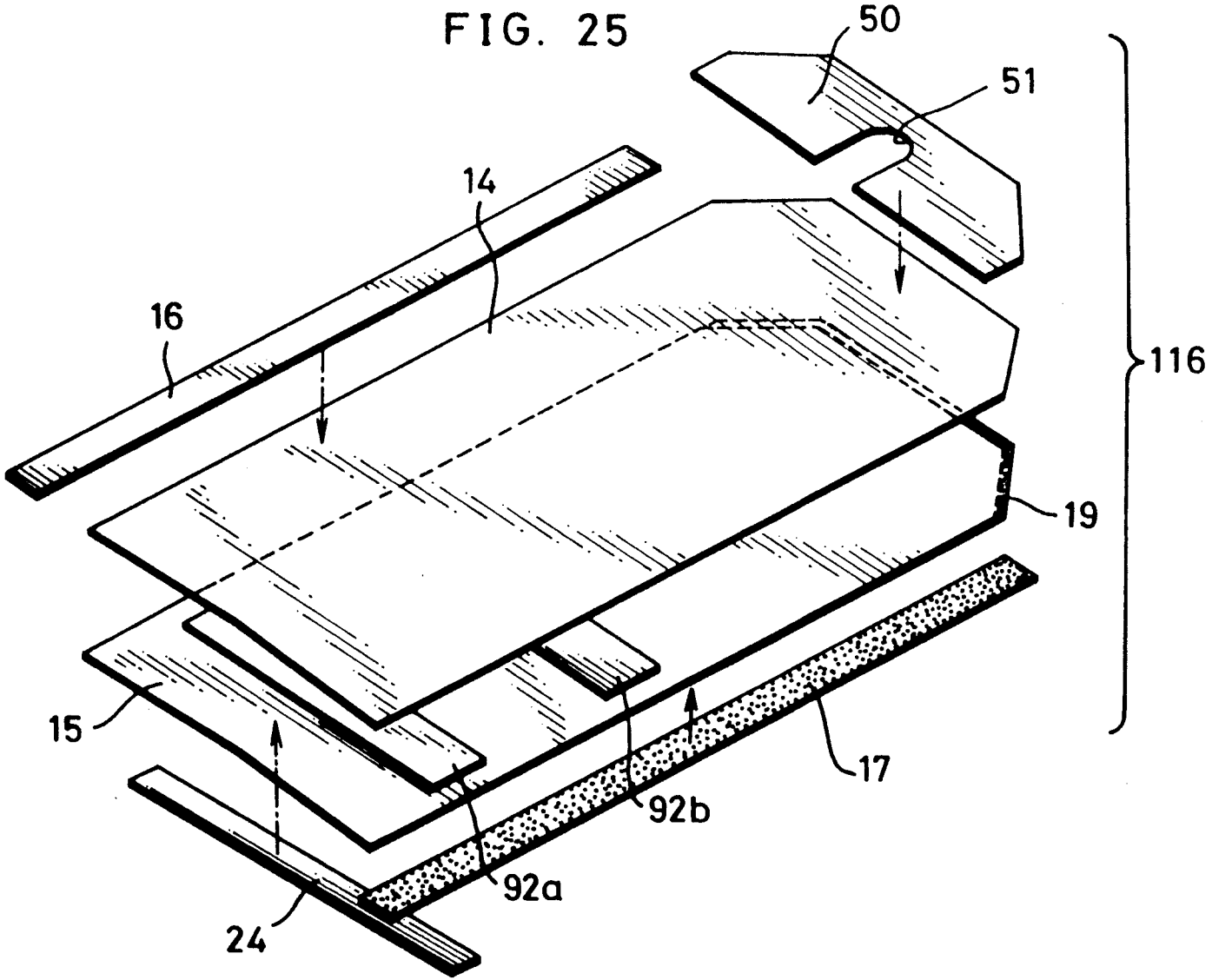
FIG. 25 is an exploded perspective view of a light-shielding envelope having a dusting tape.
Figure 26:
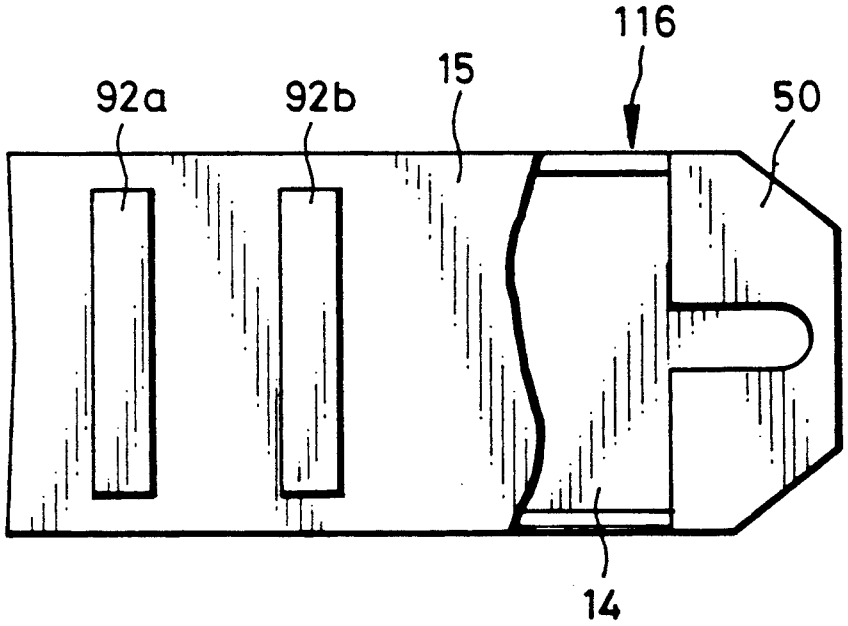
FIG. 26 is a fragmentary plan view of a photographic film package using the light-shielding envelope of FIG. 25.

FIGS. 25 and 26 show a light-shielding envelope which can remove dust or particles disposed on the back surface of a film sheet. The light-shielding envelope 116 can be used in combination with a fold-type film unit as shown in FIGS. 3, 10 or 15, as well as with a tape-attached film unit as shown in FIG. 20. On the inward facing surface of a rear sheet 15 of the light-shielding envelope 116, are adhesively applied a pair of dusting tapes **92*a* and 92*b*. These dusting tapes 92*a* and 92*b* are each shaped as a strip, and extend in a direction perpendicular to the film sheet moving direction relative to the light-shielding envelope 116. The dusting tapes 92*a* and 92*b* may be made of any material that is soft and woolly such as cotton so that it holds the dust and particles removed from the film sheet. According to the present embodiment, the dusting tapes 92*a* and 92*b*** are rectangular sheets of non-woven polypropylene fabric of 200–800 μm thick. The non-woven fabric may be made of other synthetic fiber than polypropylene, such as polyethylene, polyester, nylon, or rayon.

In the same way as above described embodiment, the light-shielding envelope 116 is slid in a film holder to place the film sheet 28 in a condition for exposure. In this state, it is possible that dust present inside the film holder may be transferred to the film sheet 28. However, during the step of sliding the light-shielding envelope 116 back into the film holder after exposure, the dusting tape **92*a* and 92*b* slide on the back surface of the film 28, so that the dust on the back surface of the film sheet 28 is wiped away first by the dusting tape 92*a* and then by the dusting tape 92*b*. Although the film sheet 28 is further moved relative to the light-shielding envelope 116 after passing by the dusting tapes 92*a* and 92*b*, since the dust has been wiped away from the back surface of the film sheet 28, the film sheet 28 will not be scratched. It is preferable to provide at least a dusting tape on the inward facing surface of a front sheet 14 of the light-shielding envelope 116, for cleaning the photosensitive emulsion surface of the film sheet 28**.

Figure 27A:
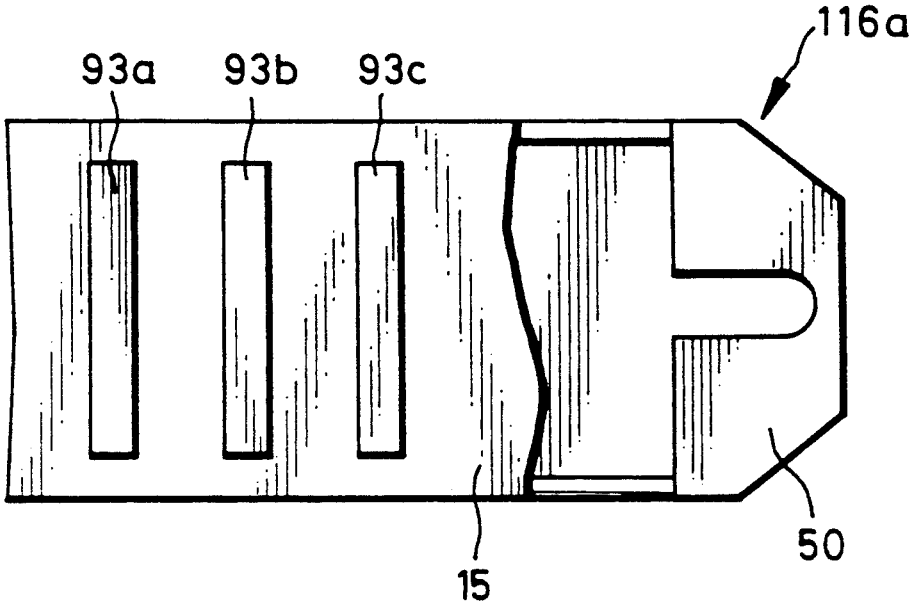
FIG. 27A to 27I are views similar to FIG. 26 but showing modifications of the dusting tape.
Figure 27B:
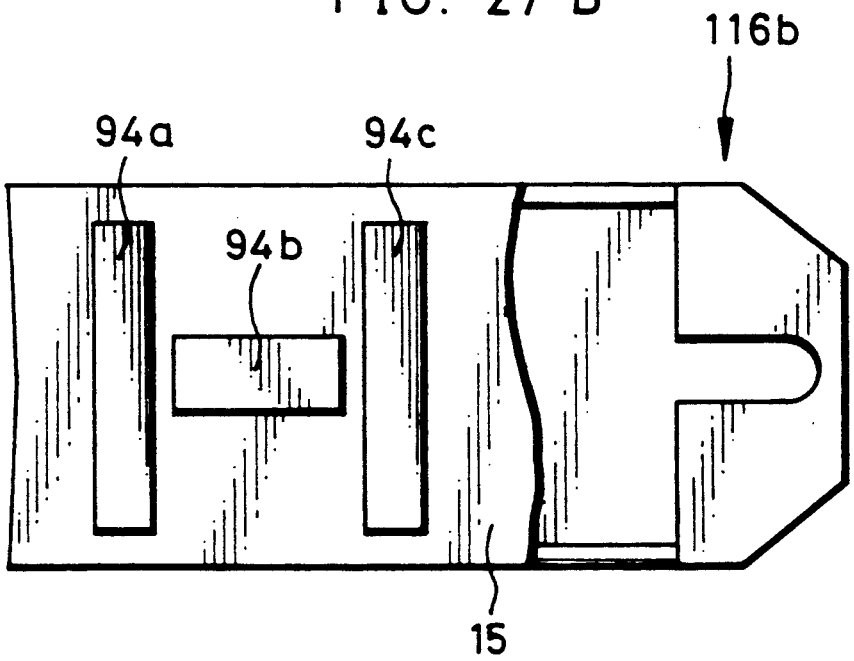
Figure 27C:
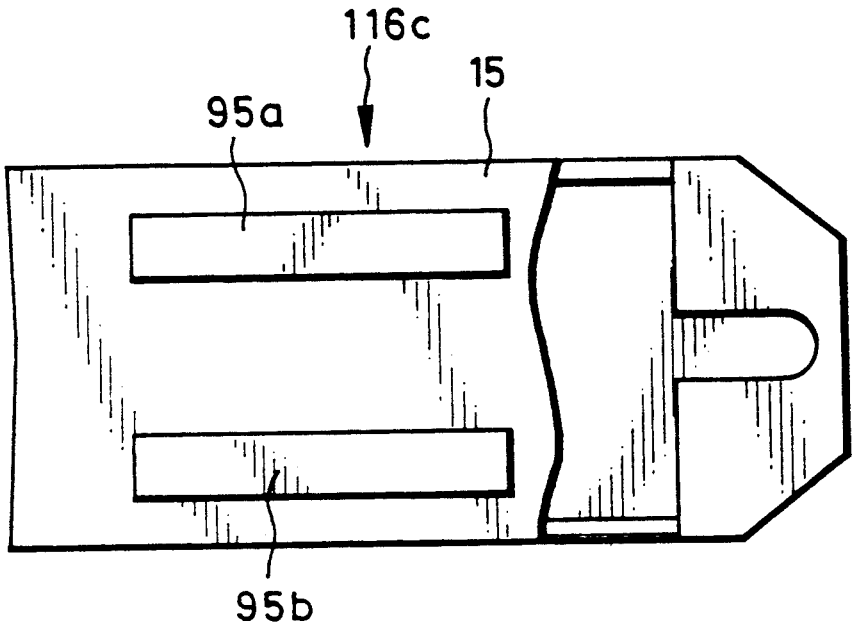
Figure 27D:
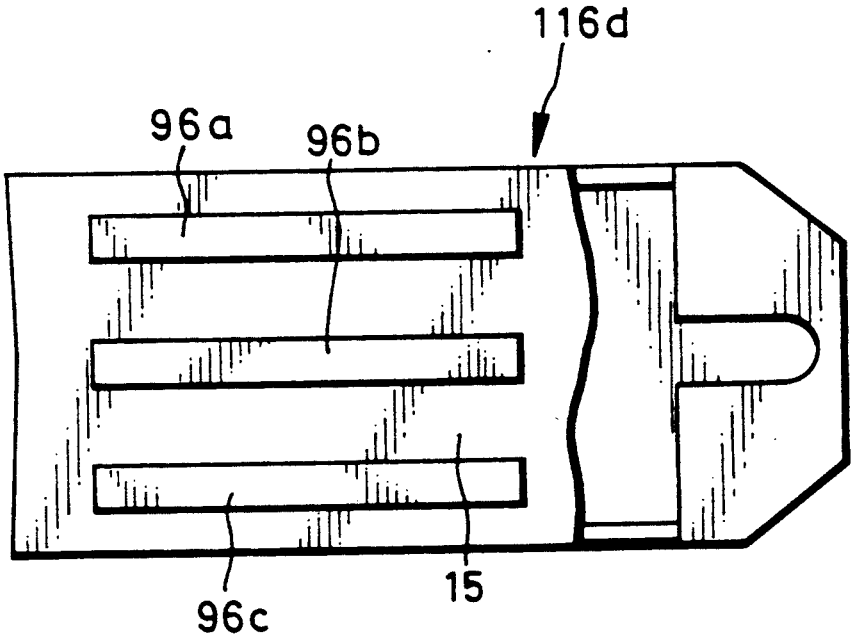
Figure 27E:
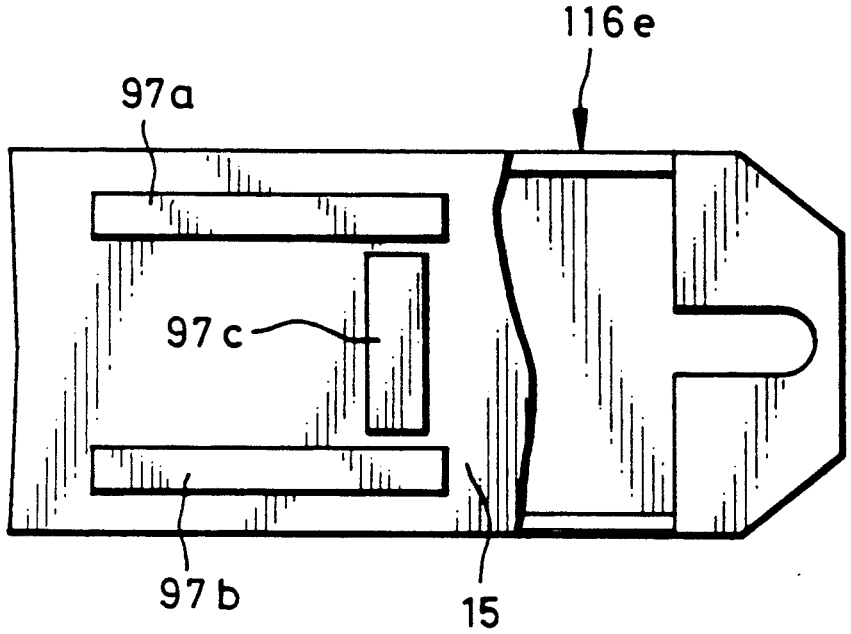
Figure 27F:
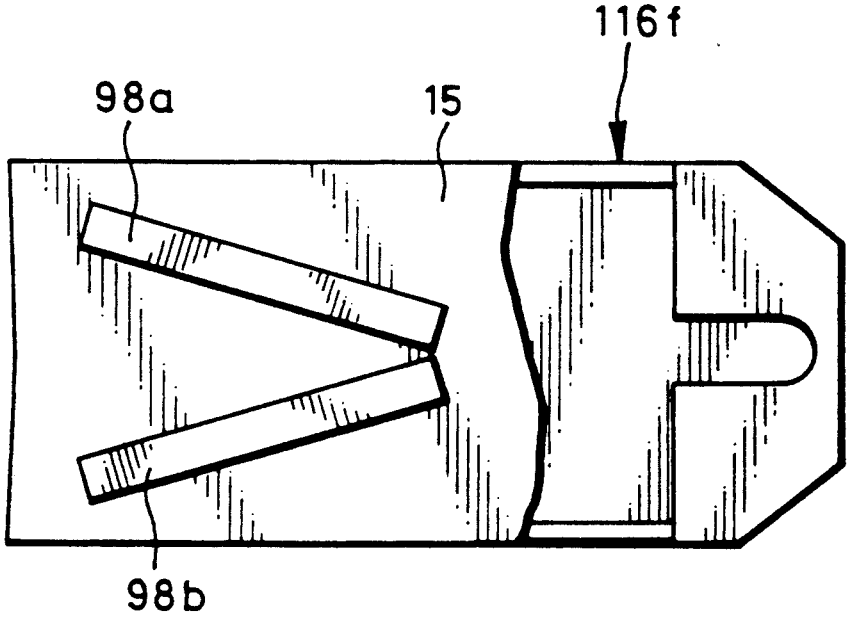
Figure 27G:
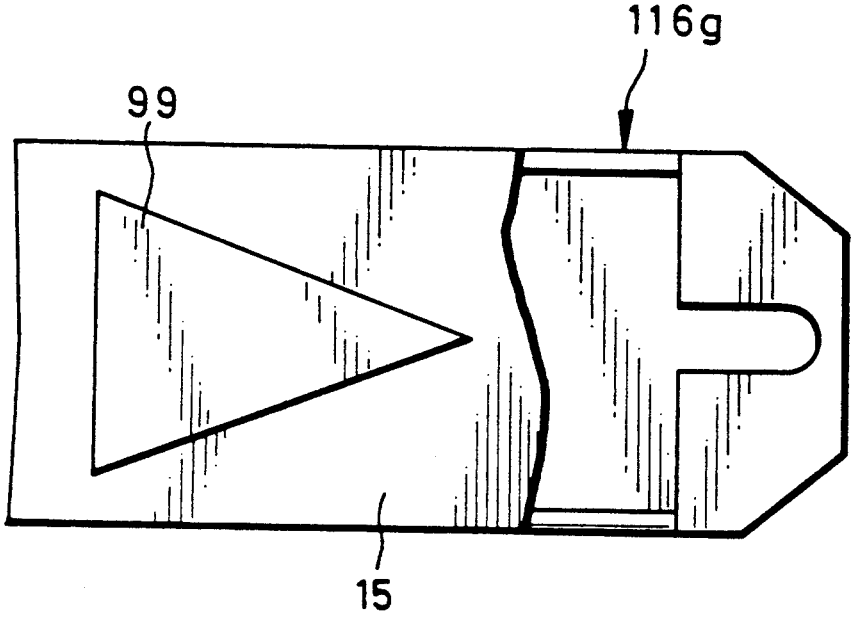
Figure 27H:
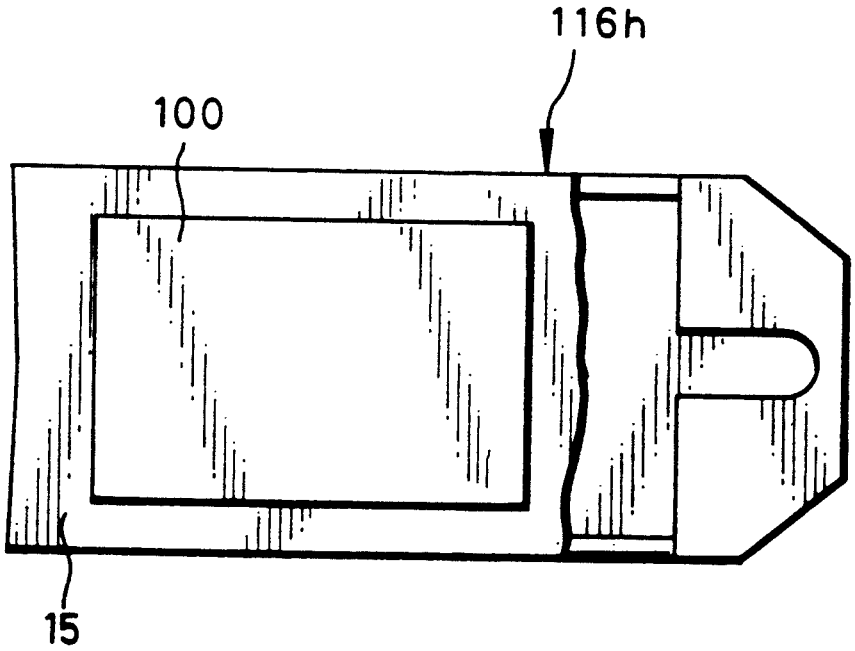
Figure 27I:
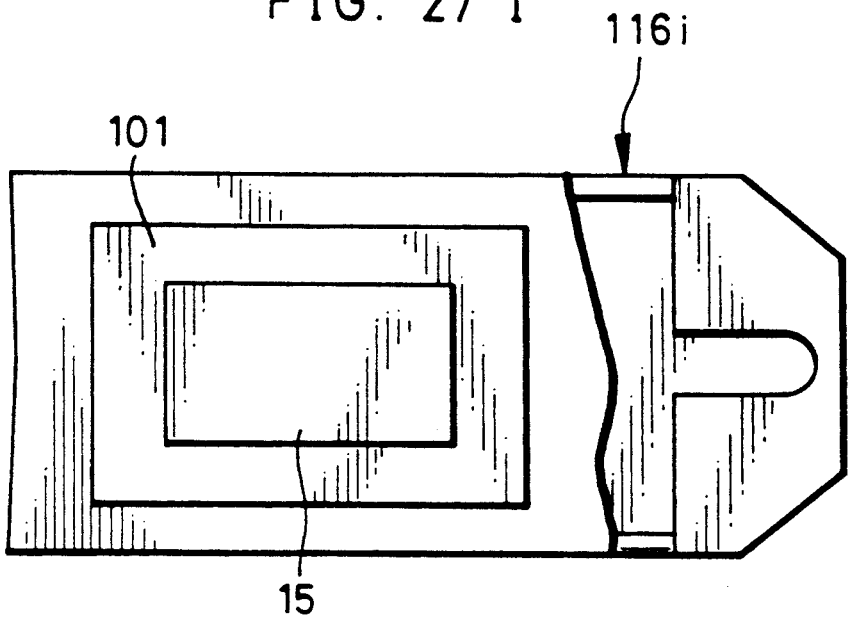

FIGS. 27A to 27I show modifications of dusting tapes disposed on the inward facing surface of a rear sheet 15. The light-shielding envelope **116*a* shown in FIG. 27A is provided with three parallel dusting tapes 93*a* to 93*c* disposed transversely to the longitudinal direction of the light-shielding envelope 116*a*. The light-shielding envelope 116*b* of FIG. 27B includes three dusting tapes 94*a* to 94*c* which are arranged to form an H-shape. The light-shielding envelope 116*c* of FIG. 27C is provided with two dusting tapes 95*a* and 95*b* disposed parallel to the longitudinal direction of the light-shielding envelope 116*c*. The light-shielding envelope 116*d* of FIG. 27D is provided with three dusting tapes 96*a* to 96*c* disposed parallel to the longitudinal direction of the light-shielding envelope 116*d*. The light-shielding envelope 116*e* of FIG. 27E is provided with three dusting tapes 97*a* to 97*c* which are arranged to form a U-shape. The light-shielding envelope 116*f* of FIG. 27F is provided with two dusting tapes 98*a* and 98*b* arranged to form a V-shape. The light-shielding envelope 116*g* of FIG. 27G is provided with a triangular dusting tape 99. The light-shielding envelope 116*h* of FIG. 27H includes a rectangular tape 100. The light-shielding envelope 116*i* of FIG. 27I is provided with a rectangular frame-shaped dusting tape 101. It is desirable to make contacting pressure between the film sheet 28** and the whole surface of each dusting tape equal.

Figure 28:
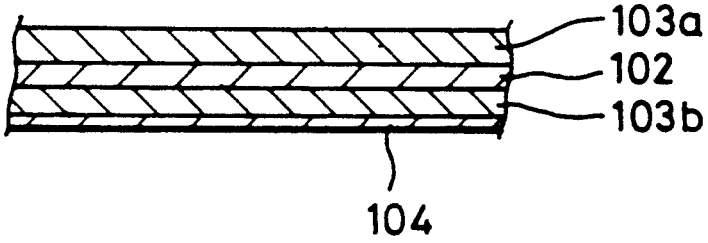
FIGS. 28 and 29 are cross-sectional views showing two modifications of the laminate construction of light-shielding envelope material.

Next, preferable examples of material for light-shielding envelope used in the respective embodiments will be described. The light-shielding envelope is preferably made of a laminate composed of plastic sheets and paper sheets, thereby to increase the stiffness of the light-shielding envelope as well as to prevent curling thereof. A material for the light-shielding envelope shown in FIG. 28 comprises three laminated layers consisting of carbon black filled paper sheets 103*a* and 103*b* laminated on the opposite surface of a polyolefin thermoplastic synthetic resin sheet such as a polyethylene sheet 102, for example, by polyethylene extrusion laminating. The three-layer laminated sheet as shown in FIG. 28 is superior to a laminate wherein a resin coating is applied on only one surface of a paper sheet, as it prevents curling. The paper sheets 103*a* and 103*b* are substantially equal in the degree of shrinkage in relation to temperature variation and/or humidity variation, so that the laminate 28 will not curl toward one side.

Because the paper sheet 103*b* forms the inward facing surface of the light-shielding envelope, and thus contacts the film unit, a smoothing layer 104 of 1–15 g/m $^2$ is formed on the outer surface of the paper sheet 103*b* by waxcoating. The smoothing layer 104 helps to smoothly slide the light-shielding envelope as well as to protect the film unit from scratching. The paper sheets 103*a* and 103*b* may be cemented to the polyethylene sheet 102 by dry laminating or wet laminating, instead of extrusion laminating. The thermoplastic synthetic resin sheet may be other polyolefin thermoplastic synthetic resin sheets than the polyethylene sheet, such as homopolymer resin, copolymer resin, and mixed resin composed of more than two kinds of resin components.

Even with a laminate constructed as above, if the sheets 103*a* and 103*b* are less than 60 g/m$^2$ in weight, the stiffness of the light-shielding envelope is insufficient, so that the film package may be bent when inserted into and pulled out of a film holder. If, on the contrary, the paper sheets 103*a* and 103*b* are more than 120 g/m$^2$ in weight, it becomes rather difficult to slide the film package into and out of the film holder. Therefore, the weight of the paper sheets 103*a* and 103*b* is preferably from 60 g/m$^2$ to 120 g/m$^2$, and more preferably 90 g/m$^2$. The density of carbon black filled in the paper sheets 103*a* and 103*b* is from 2 wt % to 15 wt % (1.2–18 g/m$^2$), so as to prevent reflection on the outward facing surface of the light-shielding envelope, as well as to ensure the light-tightness of the light-shielding envelope. It is to be noted that light-tightness of the light-shielding envelope will be improved by mixing black dye in the paper sheets 103*a* and 103*b* in addition to carbon black.

In order to prevent surface-reflection, the light-shielding envelope must be black-colored at least on the outward facing surface, that is, in the paper sheet 103*a*. To ensure light-tightness, not only the paper sheets 103*a* and 103*b*, but also the polyethylene sheet 102 may be filled with carbon black. In this case, the density of carbon black is preferably set in a range from 0.5 to 10 wt %. It is proven, that with this arrangement the interior of the light-shielding envelope is maintained light-tight even though the film package is placed under light of 10,000 lux for 10 minutes.

If the polyethylene sheet 102 is less than 10 μm thick, it becomes difficult to form polyethylene film in laminate, so that the adhesive force between the paper sheets 103*a* and 103*b* and the polyethylene sheet 102 becomes insufficient. However, if the thickness of the sheet 102 is more than 70 μm, the processability of the laminating is diminished and the cost of the film package is increased. Therefore, it is preferable to set the thickness of the polyethylene sheet 102 in a range from 10 to 70 μm. It is to be noted that the polyethylene sheet 102 of 10–70 μm thick is 10–70 g/m$^2$ in weight. The polyethylene sheet 102 having such a thickness provides the light-shielding envelope with sufficient moisture resistance for preventing the interior of the light-shielding envelope from experiencing moisture. The moisture-proof property is improved by using water-resistant paper as the paper sheets 103*a* and 103*b*, or by providing the paper sheets 103*a* and 103*b* with water resisting treatment. Furthermore, the stiffness of the light-shielding envelope is further improved by impregnating the paper sheets 103*a* and 103*b* with a resin material.

Table 2 shows the results of an experiment, wherein an example of the light-shielding envelope made of the three-layer laminate according to the just described embodiment was compared with a light-shielding envelope made of paper only, with respect to facility in handling and influence of humidity on the film units enclosed in the respective envelopes. The following values were detected after the envelopes were placed under condition 1 (temperature 23° C., humidity of 65%) and condition 2 (temperature 40° C., humidity of 80%) for several hours. As seen from the table 2, the light-shielding envelope according to the embodiment of FIG. 28, was superior to the paper envelope in stiffness, slidability and moisture resistance.

TABLE 2

| | CONDITION 1 | CONDITION 2 | STIFFNESS (g.cm) |
|---|---|---|---|
| comparison (one sheet paper) | 2 B | 3 C | 20 |
| embodiment (laminated sheet) | 1 A | 1 A | 40 |

FACILITY IN HANDLING:

| | |
|---|---|
| 1 | rapidly and smoothly insertable by one hand |
| 2 | insertable if slowly pushed |
| 3 | difficult to insert often improperly loaded |

INFLUENCE OF HUMIDITY ON FILM SHEET:

| | |
|---|---|
| A | no problem |
| B | a little damaged |
| C | remarkably damaged |

Furthermore, it is proven using two experimental light-shielding envelopes, one of which is made of a laminate whose paper sheets 103*a* and 103*b* and polyethylene sheet 102 are 60 g/m$^2$, respectively, and the laminate itself is 200 μm thick, and the other of which is made of a laminate whose paper sheets 103*a* and 103*b* are 120 g/m$^2$ and whose polyethylene sheet 102 is 20 g/m$^2$, and the laminate itself is 280 μm thick, that the facility in handling of both experimental light-shielding envelopes are good after placed in either condition 1 or 2 for several hours.

Figure 29:
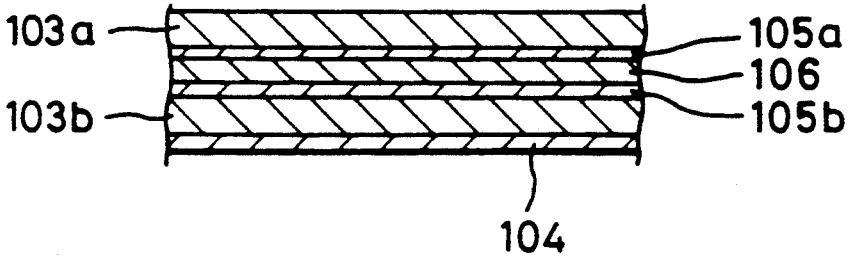

FIG. 29, shows another embodiment of a material for the light-shielding envelope. The material of this embodiment is a laminated sheet consisting of a paper sheet 103*a*, a polyethylene-terephthalate film 106, and a paper sheet 103*b* which are laminated on one another by an adhesive layer 105*a* and an adhesive layer 105*b*.

Next, the light-locking clip 13 will be described in more detail. The light-locking clip 13 is secured to the first carrier sheet 27 by caulking. The caulking strength is increased as the thickness of the first carrier sheet 27 increases. For example, if the first carrier sheet is 50 μm thick, the caulking strength is less than 3 kg, whereas if the first carrier sheet is 188 μm thick, the caulking strength is more than 7 kg. However, if the first carrier sheet 27 is too thick, the difference in height between the top surface of the first carrier sheet and that of the film sheet 28 becomes too large to smoothly move the envelope relative to the film sheet 28. Therefore, according to the present embodiment, the thickness of the first carrier sheet 27 is set at 100 μm, but it may be set at value within a range of 80 to 150 μm. Furthermore, the first carrier sheet 27 is black-colored so as to prevent light piping that might be caused if the first carrier sheet 27 were transparent, and enters external light inside the light-shielding envelope. However, the first carrier sheet 27 may be colors other than black.

Figure 30:
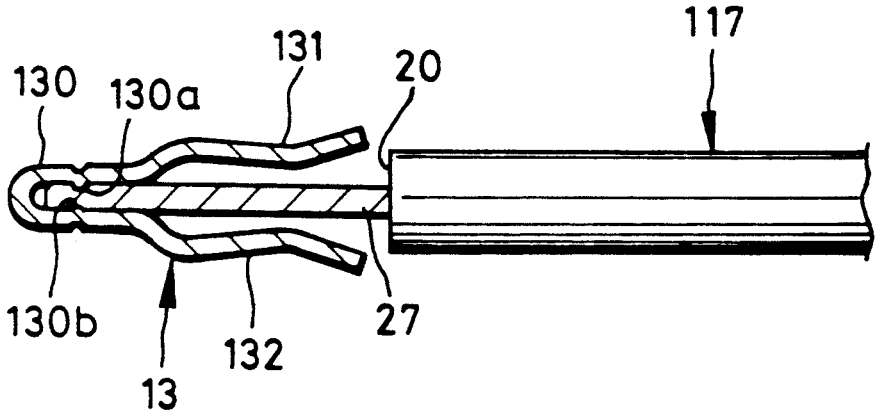
FIG. 30 is a cross-sectional view of a light-locking clip.
Figure 31:
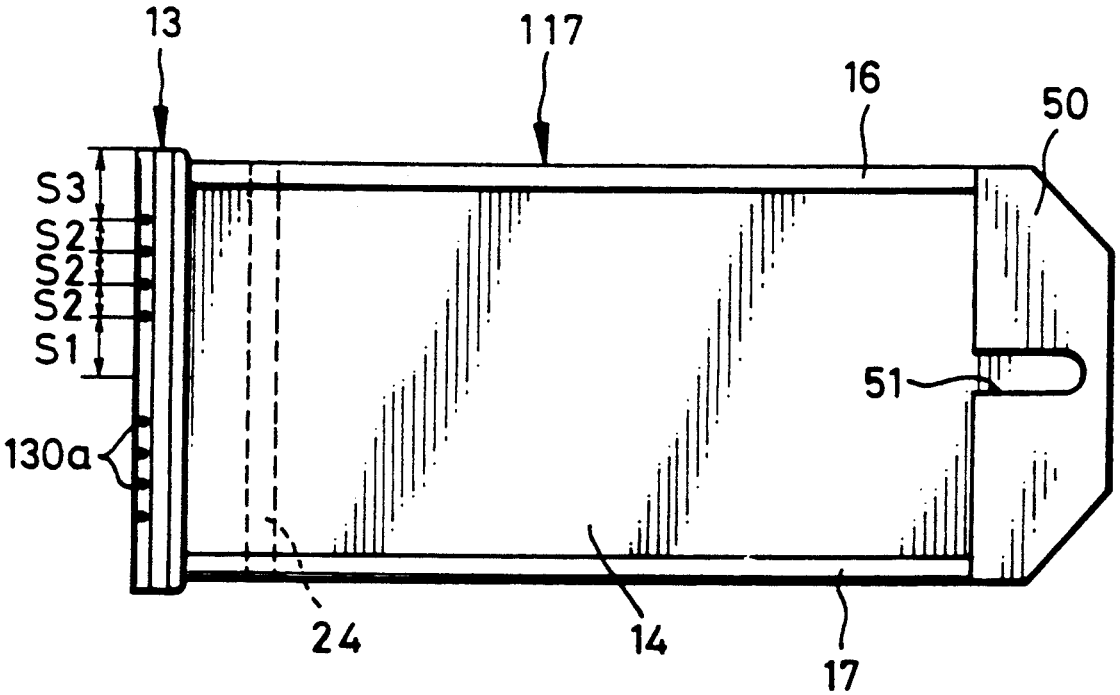
FIG. 31 is a plan view of a photographic film package showing the caulking position of the light-locking clip.

In FIG. 30, the light-locking clip 13 is made of cold rolled steel plate of 0.15 mm thick with the outward-facing surface painted black. The light-locking clip 13 comprises a U-shaped portion 130 and a pair of clamping portions 131 and 132 connected through the U-shaped portion 130. The U-shaped portion 130 is caulked from opposite sides at several points while holding the trailing end of the first carrier sheet 27 in the recess of the U-shaped portion 130. At the respective pairs of caulking points 130*a* and 130*b*, there are formed bosses which protrude inwardly from opposite sides to penetrate into the first carrier sheet 27, so that a caulking strength of 5.5 kg is obtained. Thus, the light-locking clip 13 is tightly secured to the first carrier sheet 27. As shown in FIG. 31, eight caulking points 130*a* are disposed in a line on the front side of the light-locking clip 13. On the rear side of the light-locking clip 13, there are eight caulking points 130*b* corresponding to the caulking points 130*a*. The eight caulking points 130*a* or 130*b* are separated at the center of the light-locking clip 13 into two groups of four caulking points. In each group, the caulking point closest to the center of the light-locking clip is spaced by a distance S1, e.g., 11.7 mm, from the center, and the four caulking points are spaced a distance S2, e.g., 8 mm, apart. The spacing S3 from the respective side edges of the light-locking clip to the outer most caulking points is set at 20 mm, so as not to adhere the side edges of the clamping portions 131 and 132 to each other. According to the present embodiment, the thickness of the light-locking clip 13 is 0.15 mm, but may be another value with a range from 0.10 to 0.20 mm. It is also possible to provide zinc metal plating of 20 μm in thickness on both surfaces of the light-locking clip 13, before painting the light-locking clip 13 black.

Figure 32:
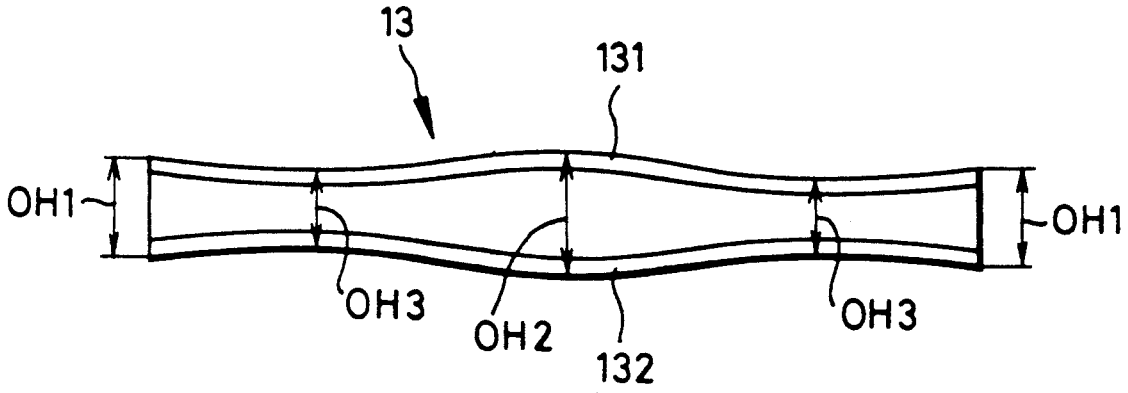
FIG. 32 is an explanatory view showing the open end edges of the light-locking clip.

As illustrated in FIG. 32, the open end 20 of a light-shielding envelope 117 tends to bulge outwardly in the middle portion thereof. The end edges of the clamping portions 131 and 132 are also arched outwardly to facilitate insertion of the swelled middle portion of the open end 20 into the recess between the clamping portions 131 and 132. In FIG. 32, OH1, OH2 and OH3 designate the height of the end surface of the clamping portions 131 and 132 at the side edges thereof, the center thereof, and intermediate points between the respective side edges and the center, respectively. Table 3 shows the results of an experiment on the effect of the size of the gap between the clamping portions 131 and 132 on the ability to fit the light-locking clip 13 onto the light-shielding envelope 117. This experiment was made using three examples (X, Y and Z) of the light-locking clip 13 having different combinations of values for OH1, OH2 and OH3. The first carrier sheet 27 and 100 μm thick, and the maximum thickness of the light-shielding envelope 117 was 700 μm. It is to be noted that the thickness of the light-shielding envelope 117 is maximum at both side edge portions.

TABLE 3

| | EXAMPLE | | |
|---|---|---|---|
| HEIGHT | CLIP X | CLIP Y | CLIP Z |
| OH1 | 2.85 | 2.45 | 2.85 |
| OH2 | 2.85 | 2.85 | 2.65 |
| OH3 | 2.65 | 2.45 | 2.65 |
| PERFORMANCE | good | good | bad |

It was proved by the above experiment that the light-shielding envelope 117 cannot be fitted into the light-locking clip 13 when OH1=OH2=OH3<2.1 mm. Furthermore, as seen from the table 3, the light-shielding envelope 117 cannot be fitted into the light-locking clip 13 when OH1 is more than OH2. Accordingly, in a preferred light-shielding envelope the relative values satisfy the equation, OH3≦OH1≦OH2.

Next, a preferred embodiment of the open end 20 of the light-shielding envelope 117 will be described. In order to equalize the caulking strength of the light-locking clip 13, it is preferable to arrange the caulking points at regular intervals and to dispose the first and last caulking points as close to the side edges of the carrier sheet 27 as possible. However, if the open end of the light-shielding envelope is straight, the edge of the opening would strike against the bosses formed at the caulking points 130*a* and 130*b*, and could not be sufficiently fitted into the light-locking clip 13.

Figure 33:
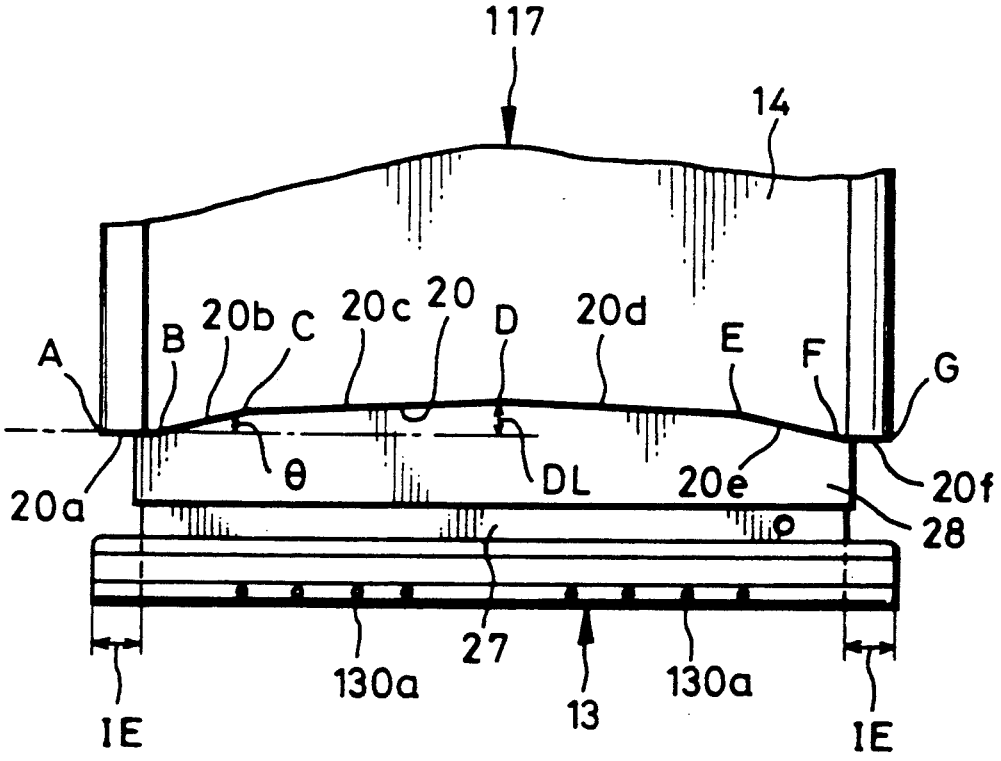
FIG. 33 is an enlarged fragmentary plan view of the photographic film package, showing the access opening of the light-shielding envelope.

FIG. 33 shows an embodiment wherein the edge of the open end 20 is so shaped as to make it possible to insert both side edge portions of the opening 20 completely into the recess of the U-shaped portion 130, so that the open end 20 is sealed light-tightly. The front edge of the open end 20 is symmetric relative to the longitudinal center D of the light-shielding envelope 117, and comprises a straight edge portion 20*a*, a first bevel edge portion 20*b*, and a second bevel edge portion 20*c*, on one side of the center D, and a third bevel edge portion 20*d*, a fourth bevel edge portion 20*e* and a straight edge portion 20*f*, on the other side of the center D. The straight edge portions 20*a* and 20*f* are parallel to the longitudinal direction of the liqht-locking clip 13. The first and fourth bevel edge portions 20*b* and 20*e* are inclined at an angle $\theta$ e.g , 10° to the straight edge portion 20*a*. The inclination angle of the third and fourth bevel edge portions 20*c* and 20*d* is less than the angle $\theta$. It may be possible to cut the middle portion of the open end 20 to form an arched edge which is symmetrical relative to the center, instead of cutting it to form a V-shaped edge consisting of the third and fourth bevel edge portions 20*c* and 20*d*.

Referring to FIG. 33, wherein A and G designate the corner points of the side edges, and B, C, D, E and F designate the respective corner points between the edge portions 20*a* to 20*f*, the center corner point D is retracted by a distance DL, e.g., 4 mm, from the straight edge portion 20*a* or 20*f*.

As described above, when the light-shielding envelope 117 is pushed into a film holder after being pulled out therefrom, the straight edge portions 20*a* and 20*f*, the first and fourth bevel edge portions 20*b* and 20*e*, and the second and third bevel edge portions 20*c* and 20*d* are successively fitted into the light-locking clip 13 in the stated order. In this way, the front sheet 14 and the rear sheet 15 are forced toward each other gradually from both side portions toward the middle portion, 50 that the open end 20 can be smoothly sealed by the light-locking clip, even when the middle portion of the open end 20 is swelled upon grasping the leading end portion of the light-shielding envelope 117. Because the second and third bevel edge portions 20*c* and 20*d* are retracted toward the leading end of the envelope 117, the straight edge portions 20*a* and 20*f* can be fully fitted into the recess of the U-shaped portion 130 of the light-locking clip 13 in both side areas IE of the light-locking clip 13, and thus the side edge portions of the light-shielding envelope 117 are surely clamped by the light-locking clip 13. By disposing the corner points C and E closer to the corner points A and G, respectively, it is possible to dispose the side most caulking points closer to the side edges of the first carrier sheet 27. By decentralizing the caulking points, the joint between the light-looking clip 13 and the first carrier sheet 27 becomes stronger.

Table 4 shows the results of an experiment conducted on the effect of the size of the straight edge portions 20*a* and 20*f* on the facility of inserting the light-shielding envelope 117 into the light-locking clip 13 (property A), as well as on the light-tightness of the seal (property B). In the table 4, the numbers 1, 2 and 3 represent the grade: very good, good and bad, respectively, with respect to these properties. As seen from the results of this experiment, it is preferable to set the size of the straight edge portion 20*a* or 20*f* within a range from 3 mm to 6 mm.

TABLE 4

| | SIZE OF STRAIGHT EDGE (mm) | | |
|---|---|---|---|
| | 0-3 | 3-6 | more than 6 |
| PROPERTY A | 1 | 1 | 3 |
| PROPERTY B | 2 | 1 | 1 |

Table 5 shows the results of an experiment on the effect of the angle $\theta$ on the facility in inserting the light-shielding envelope 117 into the light-locking clip 13 (property A). As seen from the results of this experiment, it is preferable to set the angle $\theta$ within a range from 5° to 20°.

TABLE 5

| | ANGLE 0 | | |
|---|---|---|---|
| | less than 5° | 5°-20° | more than 20° |
| Property A | 3 | 1 | 3 |

The present invention has now been described in detail with particular reference to its preferred embodiments as illustrated herein. It will be understood, however, that variations and modifications can be effected within the spirit and scope of this invention. For example, it is possible to provide a second photographic film sheet on the opposite side of the first and second carrier sheets 27 and 29 from the photographic film sheet 28.

What is claimed is:

1. A photographic film package, comprising:

a film unit having a photographic film sheet, a light-locking clip, and first and second carrier sheets which are removable attached to trailing and leading ends of said photographic film sheet, respectively, said light-locking clip being attached to a trailing end of said first carrier sheet; and a light-shielding envelope having an access opening which is adapted to be sealed by said light-locking clip for enclosing said photographic film sheet in light-tight fashion, wherein said second carrier sheet is formed with a grip opening extending in a leading end portion thereof transversely to the longitudinal direction of said film unit, and said opening allows inward-facing surfaces of said light-shielding envelope to contact each other when said light-shielding envelope is grasped.

2. A photographic film package as recited in claim 1, further comprising a reinforcement sheet mounted on at least one surface of said light-shielding envelope in a leading end portion thereof.

3. A photographic film package as recited in claim 2, wherein said reinforcement sheet is formed with a cut-out for allowing a finger to contact directly with said light-shielding envelope, such that said cut-out overlaps said grip opening when said light-locking clip clamps said access opening of said light-shielding envelope.

4. A photographic film package as recited in claim 2, wherein the leading end portion of said light-shielding envelope, a leading end portion of said second carrier sheet and said reinforcement sheet are of a trapezoidal shape.

5. A photographic film package as recited in claim 4, wherein said second carrier sheet is folded together with said light-shielding envelope on a folding line along an end edge of said reinforcement sheet after photographing, and the folded condition is maintained by an adhesive tape.

6. A photographic film package as recited in claim 5, wherein a distance from said folding line to the leading end of said second carrier sheet is shorter than a distance from said folding line to the leading end of said photographic film sheet.

7. A photographic film package as recited in claim 6, wherein said adhesive tape is a double-coated tape attached with a release paper, and is adhered to the leading end portion of said light-shielding envelope so as to secure the leading end portion of said light-shielding envelope to an intermediate portion of said envelope when said envelope is folded.

8. A photographic film package as recited in claim 6, wherein said folding line extends through said grip opening so as to facilitate folding of said second carrier sheet.

9. A photographic film package as recited in claim 8, wherein said second carrier sheet is formed with a second grip opening extending along said folding line, so as to facilitate folding of said second carrier sheet.

10. A photographic film package as recited in claim 2, further comprising an adhesive tape removably adhered to said light-shielding envelope, said adhesive tape being adapted to secure said light-locking clip to said light-shielding envelope when said light-locking clip clamps said access opening after photographing, so as to prevent said light-locking clip from slipping out of said light-shielding envelope without said second carrier sheet being folded.

11. A photographic film package as recited in claim 10, wherein said adhesive tape is a double-sheet tape consisting of an inside tape which is secured to said light-shielding envelope, and an outside tape which is removably attached on a top surface of said inside tape, and wherein said inside tape has an indicia on the top surface thereof which indicates that the photographic film package has been exposed.

12. A photographic film package as recited in claim 11, wherein said outside tape is provided with a cut line extending orthogonally to the longitudinal direction of said outside tape, for facilitating removal of said outside tape.

13. A photographic film package as recited in claim 12, wherein said reinforcement sheet has a cut-off portion and is disposed on the front surface of said envelope, and said double-sheet tape is disposed on the rear surface of said envelope such that said cut line crosses the edge of said cut-off portion, so that said outside tape can be peeled from said inside tape along said cut line when said light-shielding envelope is forwardly bent along the edge of said cut-off portion.

14. A photographic film package as recited in claim 1, wherein said film unit further comprises a height difference compensating sheet attached to said second carrier sheet adajcent to said film sheet, said height difference compensating sheet compensating for the relative difference in height between said second carrier sheet and said film sheet to thereby prevent the leading end of said film sheet from being caught by an end edge of said access opening of said light-shielding envelope.

15. A photographic film package as recited in claim 14, wherein the leading end of said first carrier sheet and the leading end of said height difference compensating sheet are tapered.

16. A photographic film package as recited in claim 1, wherein said first and second carrier sheets are removably attached to a back surface of said film sheet.

17. A photographic film package as recited in claim 1, wherein said access opening of said light-shielding envelope has straight edge portions on both sides of said access opening and a concave V-shaped edge portion in a middle of said access opening.

18. A photographic film package as recited in claim 17, wherein each of said straight edge portions of said access opening is folded down to form a double sheeted edge.

19. A photographic film package as recited in claim 1, wherein said second carrier sheet is detachably attached to inward-facing surface of said light-shielding envelope, such that said light-shielding envelope is removed from said second carrier sheet when said light-shielding envelope is pulled out therefrom.

20. A photographic film package as recited in claim 1, wherein said first and second carrier sheets are removably attached to said photographic film in such manner that said photographic film sheet is left separated from said carrier sheets in a predetermined zone along both end edges of said photographic film sheet.

21. A photographic film package as recited in claim 1, further comprising at least a discrimination element for discriminating a photosensitive emulsion surface of photographic film sheet, said discrimination element being formed in one of said first and second carrier sheets.

22. A photographic film package as recited in claim 21, wherein said discrimination element is a hole.

23. A photographic film package as recited in claim 1, wherein said light-shielding envelope is provided with a dusting tape attached to the inward-facing surface thereof, said dusting tape being adapted to wipe dust from a back surface of said photographic film sheet while said photographic film sheet is slid on said dusting tape.

24. A photographic film package as recited in claim 1, wherein said light-shielding envelope is made of a laminated sheet wherein a thermoplastic resin is disposed between two sheets of paper, said thermoplastic resin being used to provide rigidity to said light-shielding envelope.

25. A photographic film package as recited in claim 24, wherein at least one of said paper sheets is black-colored.

26. A photographic film package as recited in claim 1, wherein said light-locking clip is secured to said first carrier sheet by caulking, and wherein bosses are formed on inward-facing surfaces of said light-locking clip which contact said first carrier sheet.

27. A photographic film package as recited in claim 26, wherein said light-locking clip has a slit-like open end, the size of said open end being equal at both side ends, and wider at the center than at the side ends thereof, and an intermediate portions between the center and each side ends having a width equal to or less than the width of the side ends.

28. A photographic film package as recited in claim 26, wherein said light-locking clip has a slit-like open end, the size of said open end being equal at both side ends, whereas the width at the center thereof is equal to or more than the width at the side end, and the width at intermediate portions between the center and each side end is less than that at the center.

29. A photographic film package as recited in claim 1, wherein said access opening of said light-shielding envelope has straight edge portions on both sides, said straight edge portions extending parallel to the longitudinal direction of said light-locking clip, a V-shaped edge portion in a middle of said access opening, and bevel edge portions between said V-shaped edge portion and said straight edge portions, said bevel edge portions being angled more than said V-shaped edge portion.

30. A photographic film package as recited in claim 29, wherein each of said straight edge portions is 3–6 mm long, and said bevel edge portions form an angle within a range of approximately 5°–20° with respect to said straight edge portions.

31. A photographic film package as recited in claim 1, wherein said photographic film sheet is attached to said first and second carrier sheets by means of a resin adhesive agent having the following composition:

EAV resin: 30–70 wt %
SBR: 4–20 wt %
rosin tackifier: 4–25 wt %
chlorinated polyethylene resin: 6–20 wt %
modified amide resin: 4–15 wt %
wax: 1–10 wt %
silica: 0.1–8 wt %
anti-oxidant: 0.01–2.0 wt %

32. A photographic film package, comprising:

a film unit including a photographic film sheet, a light-locking clip, and first and second carrier sheets which are removable attached to trailing and leading ends of said photographic film sheet, respectively, said light-locking clip being attached to a trailing end of said first carrier sheet; and a light-shielding envelope having an access opening adapted to be sealed by said light-locking clip for enclosing said photographic film sheet in light-tight fashion, wherein said second carrier sheet is formed with first and second openings extending in a leading end portion thereof transversely to the longitudinal direction of said film unit, such that said first opening allows inward-facing surfaces of said light-shielding envelope to contact each other when said light-shielding envelope is grasped, and said second opening facilitates folding of said second carrier sheet together with said light-shielding envelope when said light-shielding envelope encloses said photographic film sheet in light-tight fashion after photographing.

33. A photographic film package as recited in claim 32, wherein said film unit further comprises a reinforcement sheet mounted on a surface of said light-shielding envelope in a leading end portion thereof, such that an edge of said reinforcement sheet is disposed on said second opening so as to facilitate folding of said light-shielding envelope along said edge of said reinforcement sheet.

34. A photographic film package as recited in claim 33, wherein said first and second carrier sheets are removable attached to a back surface of said photographic film sheet.

35. A photographic film package as recited in claim 34, wherein said reinforcement sheet is formed with a cut-out for allowing a finger to contact directly with said light-shielding envelope, such that said cut-out overlaps said opening when said light-locking clip clamps said access opening of said light-shielding envelope.

36. A photographic film package as recited in claim 35, wherein the leading end portion of said light-shielding envelope, a leading end portion of said second carrier sheet and said reinforcement sheet are of a trapezoidal shape.

37. A photographic film package as recited in claim 36, wherein said light-shielding envelope is provided in a leading end portion thereof with a double-coated tape, to a top surface of which a release paper is applied, said double-coated tape being used to secure the leading end portion of said light-shielding envelope to an intermediate portion thereof when said light-shielding envelope is folded.

38. A photographic film package, comprising:

a film unit including a photographic film sheet, a light-locking clip, and first and second carrier sheets which are removable attached to trailing and leading ends of said photographic film sheet, respectively, said light-locking clip being attached to a trailing end of said first carrier sheet; and a light-shielding envelope having an access opening which is adapted to be sealed by said light-locking clip for enclosing said photographic film sheet in light-tight fashion, wherein said photographic film sheet is left separated along the outer portion thereof from said first and second carrier sheets by a predetermined amount.

39. A photographic film package, comprising:

a film unit including a photographic film sheet, a light-locking clip, and first and second carrier sheets which are removable attached to trailing and leading ends of said photographic film sheet, respectively, said light-locking clip being attached to a trailing end of said first carrier sheet; and a light-shielding envelope having an access opening which is adapted to be sealed by said light-locking clip for enclosing said photographic film sheet in light-tight fashion, wherein at least one of said first and second carrier sheets has a discriminating opening for discriminating between a photosensitive emulsion surface and a backing surface of said photographic film sheet during manufacturing.

40. A photographic film package, comprising:

a film unit including a photographic film sheet, a light-locking clip, and first and second carrier sheets which are removable attached to trailing and leading ends of said photographic film sheet with a hot-melt adhesive agent, respectively, said light-locking clip being attached to a trailing end of said first carrier sheet; and a light-shielding envelope having an access opening which is adapted to be sealed by said light-locking clip for enclosing said photographic film sheet in light-tight fashion, wherein said hot-melt adhesive agent has the following composition:

EAV resin: 30–70 wt %
SBR: 4–20 wt %
rosin tackifier: 4–25 wt %
chlorinated polyethylene resin: 6–20 wt %
modified amide resin 4–15 wt %
wax: 1–10 wt %
anti-oxidant: 0.01–2.0 wt %
silica: 0.1–8 wt %

41. A photographic film package, comprising:

a film unit including a photographic film sheet, a light-locking clip, and first and second carrier sheets which are removable attached to trailing and leading ends of said photographic film sheet, respectively, by means of a hot-melt adhesive agent, and said light-locking clip being attached to a trailing end of said first carrier sheet;

a light-shielding envelope having an access opening which is adapted to be sealed by said light-locking clip for enclosing said photographic film sheet in light-tight fashion; and a dusting tape attached to an inward-facing surface of said light-shielding envelope, said dusting tape being adapted to wipe dust from at least a backing surface of said photographic film sheet while said photographic film sheet is being slid inside said light-shielding envelope.

42. A photographic film package, comprising:

a film unit including a photographic film sheet, a light-locking clip, and first and second carrier sheets which are removable attached to trailing and leading ends of said photographic film sheet, respectively, by means of a hot-melt adhesive agent, said light-locking clip being attached to a trailing end of said first carrier sheet; and a light-shielding envelope having an access opening which is adapted to be sealed by said light-locking clip for enclosing said photographic film sheet in light-tight fashion, wherein said light-shielding envelope is made of a laminated sheet in which a thermoplastic resin is disposed between two sheets of colored paper, said thermoplastic resin being used to give rigidity to said light-shielding envelope.

43. A photographic film package as recited in claim 42, wherein said light-shielding envelope is formed on the inward facing surface thereof with a smoothing layer.

44. A photographic film package, comprising:

a film unit including a photographic film sheet, a light-locking clip, and first and second carrier sheets which are removable attached to trailing and leading ends of said photographic film sheet, respectively, by means of a hot-melt adhesive agent, said light-locking clip being attached to a trailing end of said first carrier sheet; and a light-shielding envelope having an access opening which is adapted to be sealed by said light-locking clip for enclosing said photographic film sheet in light-tight fashion, wherein said light-locking clip comprises an U-shaped portion for nipping the trailing end of said first carrier sheet and a pair of clamping portions for clamping said access opening of said light-shielding envelope therebetween, said U-shaped portion being formed on both inward-facing surfaces with a plurality of bosses which are formed by caulking and which protrude inwardly so as to penetrate into said first carrier sheet to provide maximum retaining strength and wherein said plurality of bosses are symmetrically disposed relative to the center of said light-locking clip along the longitudinal direction thereof, except for the center portion.

45. A photographic film package as recited in claim 44, wherein said clamping portions of said light-locking clip are spaced from each other by the same distance on both lateral sides and at the center thereof, and are spaced from each other by a smaller distance at intermediate portions between the center and the side portions.

46. A photographic film package as recited in claim 44, wherein end edges of said clamping portions of said light-locking clip are spaced from each other by the same distance on both lateral side portions of said light-locking clip, and are outwardly convex at said side portions and inwardly concave in the middle portion.

47. A photographic film package, comprising:

a film unit including a photographic film sheet, a light-locking clip, and first and second carrier sheets which are removable attached to trailing and leading ends of said photographic film sheet, respectively, by means of a hot-melt adhesive agent, said light-locking clip being attached to a trailing end of said first carrier sheet; and a light-shielding envelope having an access opening which is adapted to be sealed by said light-locking clip for enclosing said photographic film sheet in light-tight fashion, wherein said access opening has straight edge portions on both sides thereof, said straight edge portions extending parallel to the longitudinal direction of said light-locking clip, a V-shaped edge portion in a middle thereof, and bevel edge portions between said V-shaped edge portion and said straight edge portions and wherein said bevel edge portions are angled more than said V-shaped edge portion.

48. A photographic film package as recited in claim 47, wherein said straight edge portions are each 3 mm–6 mm long, and said bevel edge portions are inclined within a range of approximately 5°–20° with respect to said straight edge portions.

49. A photographic film package as recited in claim 38, 39, 41, 42, 44 or 47, wherein said second carrier sheet is formed with a grip opening extending transversely to said film unit in a leading end portion of said second carrier sheet, said opening being adapted to allow the inward-facing surfaces of said light-shielding envelope to contact each other when said light-shielding envelope is grasped.

50. A photographic film package as recited in claim 49, wherein said first and second carrier sheets are removably attached to a back surface of said film sheet.

51. A photographic film package as recited in claim 50, further comprising a reinforcement sheet mounted on at least one surface of said light-shielding envelope in a leading end portion thereof.

52. A photographic film package as recited in claim 51, wherein the leading end portion of said light-shielding envelope, a leading end portion of said second carrier sheet and said reinforcement sheet are of a trapezoidal shape.

53. A photographic film package as recited in claim 52, wherein said reinforcement sheet is formed with a cut-out for allowing a finger to contact directly with said light-shielding envelope, such that said cut-out overlaps said grip opening when said light-locking clip clamps said access opening of said light-shielding envelope.

* * * * *